US007481514B2

(12) United States Patent
Otokita

(10) Patent No.: US 7,481,514 B2
(45) Date of Patent: Jan. 27, 2009

(54) PRINTING METHOD, CONTROL METHOD, PRINTING APPARATUS, CONTROL APPARATUS, AND COMPUTER-READABLE STORAGE MEDIUM

(75) Inventor: Kenji Otokita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1040 days.

(21) Appl. No.: 10/823,794

(22) Filed: Apr. 14, 2004

(65) Prior Publication Data

US 2005/0007415 A1 Jan. 13, 2005

(30) Foreign Application Priority Data

Apr. 15, 2003 (JP) ..... 2003-110843

(51) Int. Cl.
*B41J 2/15* (2006.01)

(52) U.S. Cl. ..... 347/41

(58) Field of Classification Search ..... None
See application file for complete search history.

(56) References Cited

U.S. PATENT DOCUMENTS 6,267,467 B1 * 7/2001 Otsuki ..... 347/43
6,666,539 B2 * 12/2003 Sato ..... 347/15

FOREIGN PATENT DOCUMENTS

JP 2000-198237 A 7/2000

* cited by examiner

*Primary Examiner*—Twyler L. Haskins
*Assistant Examiner*—Marcus T Riley
(74) *Attorney, Agent, or Firm*—Sughrue Mion, PLLC

(57) ABSTRACT

A method for printing an image whose resolution in a first direction is higher than that in a second direction by forming first dots or smaller second dots at positions on the medium of pixels structuring the image. The second dot is formed at a position of a certain pixel if the first dot is to be formed at the position of the certain pixel, and at least one of the following conditions is met: no dot is to be formed at a position of one of two pixels adjacent, in the first direction, to the certain pixel, and no dot is to be formed at positions of two pixels adjacent, in the second direction, to that adjacent pixel; or no dot is to be formed at a position of the other of the two adjacent pixels, and no dot is to be formed at positions of two pixels adjacent, in the second direction, to the other adjacent pixel.

22 Claims, 18 Drawing Sheets

PRINTING METHOD, CONTROL METHOD, PRINTING APPARATUS, CONTROL APPARATUS, AND COMPUTER-READABLE STORAGE MEDIUM

CROSS-REFERENCE TO RELATED APPLICATIONS

The present application claims priority upon Japanese Patent Application No. 2003-110843 filed Apr. 15, 2003, the contents of which are herein incorporated by reference.

BACKGROUND OF THE INVENTION

1. Field of the Invention

The present invention relates to printing methods, control methods, printing apparatuses, control apparatuses, and computer-readable storage media.

2. Description of the Related Art

Printing apparatuses, which print images by forming dots on media (such as paper, cloth, and film), appropriately select one among several resolutions (from low resolution to high resolution) which are provided in advance according to, for example, the type of media on which images are to be printed or output commands from application programs for instructing printing, and then print images on the media. (See, for example, Japanese Patent Application Laid-open Publication No. 2000-198237.)

As the resolution for printing images becomes low, the outline section (the edge) of a printed image tends to become jagged (i.e., not smooth), and as a result, the quality of the printed image deteriorates.

SUMMARY OF THE INVENTION

The present invention has been made in view of the above and other problems, and an object thereof is to improve image quality at low resolution.

An aspect of the present invention is a printing method for printing, on a medium, an image in which a resolution in a first direction is higher than a resolution in a second direction by forming first dots or second dots that are smaller than the first dots at positions on the medium that correspond to pixels structuring the image. The method comprises the step of forming the second dot at a position on the medium corresponding to a certain pixel if the first dot is to be formed at the position on the medium corresponding to the certain pixel, and at least either one of condition 1 or condition 2 below is met:

condition 1:

neither the first dot nor the second dot is to be formed at a position on the medium corresponding to one adjacent pixel of either two adjacent pixels that are adjacent, in the first direction, to the certain pixel, and neither the first dot nor the second dot is to be formed at positions on the medium corresponding to two pixels that are adjacent, in the second direction, to the one adjacent pixel; or condition 2:

neither the first dot nor the second dot is to be formed at a position on the medium corresponding to the other adjacent pixel of the two adjacent pixels, and neither the first dot nor the second dot is to be formed at positions on the medium corresponding to two pixels that are adjacent, in the second direction, to the other adjacent pixel.

Another aspect of the present invention is a control method for correlating either first dot information about a first dot or second dot information about a second dot that is smaller than the first dot to each of a plurality of pixels that structure an image in which a resolution in a first direction is higher than a resolution in a second direction, and for outputting the first dot information and the second dot information. The method comprises the step of correlating the second dot information to a certain pixel if the first dot information is correlated to the certain pixel, and at least either one of condition 1 or condition 2 below is met:

condition 1:

neither the first dot information nor the second dot information is correlated to one adjacent pixel of either two adjacent pixels that are adjacent, in the first direction, to the certain pixel, and neither the first dot information nor the second dot information is correlated to two pixels that are adjacent, in the second direction, to the one adjacent pixel; or condition 2:

neither the first dot information nor the second dot information is correlated to the other adjacent pixel of the two adjacent pixels, and neither the first dot information nor the second dot information is correlated to two pixels that are adjacent, in the second direction, to the other adjacent pixel.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
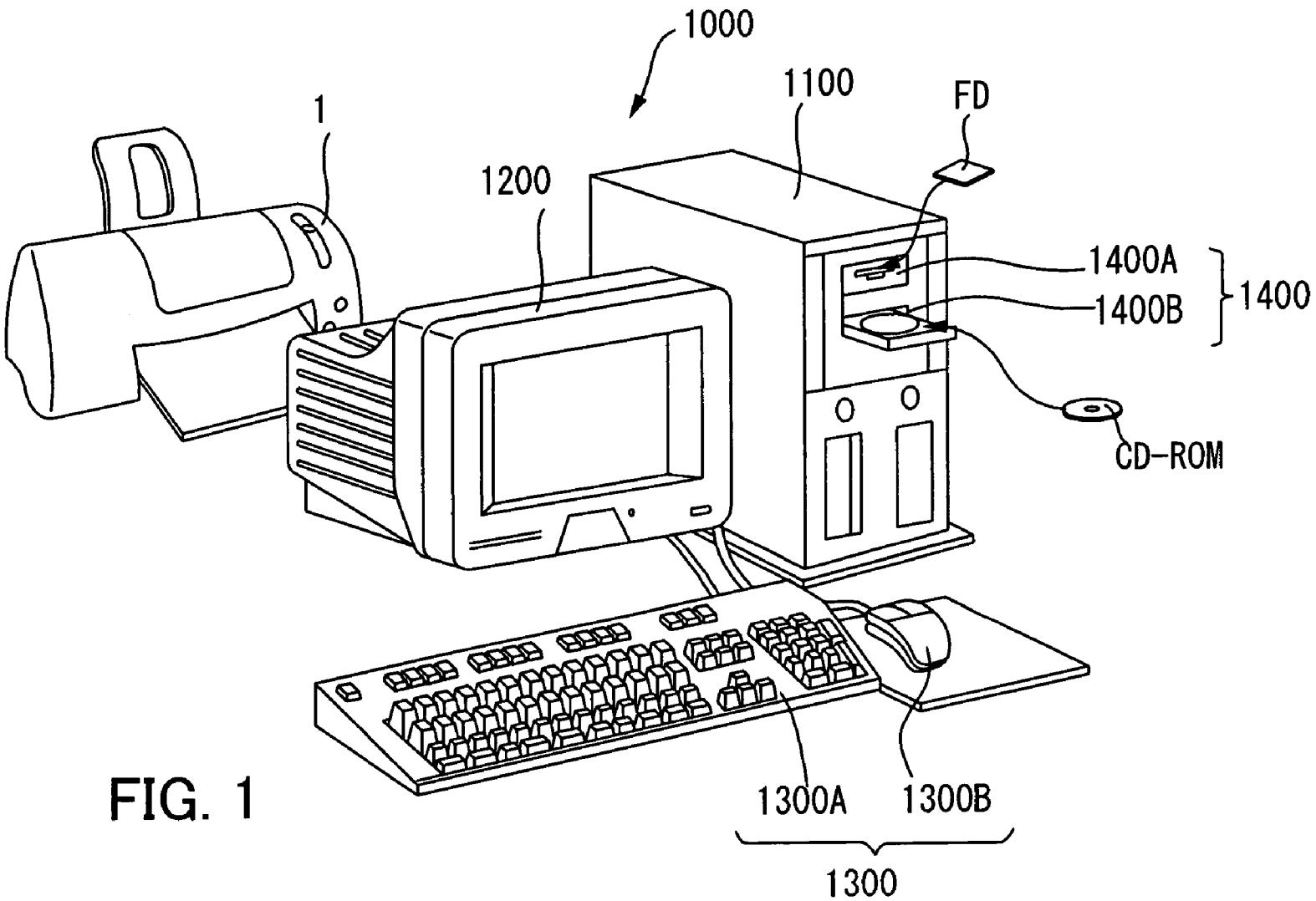
FIG. 1 is an explanatory diagram showing an overall configuration of a printing system.

At least the following matters will be made clear by the explanation in the present specification and the description of the accompanying drawings.

An aspect of the present invention is a printing method for printing, on a medium, an image in which a resolution in a first direction is higher than a resolution in a second direction by forming first dots or second dots that are smaller than the first dots at positions on the medium that correspond to pixels structuring the image, the method comprising the step of forming the second dot at a position on the medium corresponding to a certain pixel if the first dot is to be formed at the position on the medium corresponding to the certain pixel, and at least either one of condition 1 or condition 2 below is met:

condition 1:

neither the first dot nor the second dot is to be formed at a position on the medium corresponding to one adjacent pixel of either two adjacent pixels that are adjacent, in the first direction, to the certain pixel, and neither the first dot nor the second dot is to be formed at positions on the medium corresponding to two pixels that are adjacent, in the second direction, to the one adjacent pixel; or condition 2:

neither the first dot nor the second dot is to be formed at a position on the medium corresponding to the other adjacent pixel of the two adjacent pixels, and neither the first dot nor the second dot is to be formed at positions on the medium corresponding to two pixels that are adjacent, in the second direction, to the other adjacent pixel.

According to such a printing method, it is possible to improve image quality. Particularly, with this printing method, it is possible to print both slanting outline sections and rounded outline sections smoothly. Since usual images often have an outline in which slanting outline sections and rounded outline sections are continuously connected, the present printing method is particularly advantageous in carrying out high-quality printing.

Further, in the above-described printing method, it is preferable that the first dot is longer in the second direction than in the first direction. Furthermore, in the above-described printing method, it is preferable that the first dot has an oval shape. According to this printing method, the space between the dots becomes small, and thus, the image quality will not become coarse.

Further, in the above-described printing method, it is preferable that the first dots and the second dots are formed by a print head; the print head is movable in a predetermined direction; and the second direction is parallel to the predetermined direction. According to this printing method, the space between the dots becomes small, and thus, the image quality will not become coarse. Furthermore, in the above-described printing method, the medium may be carried in a carrying direction when the medium is being printed; and the second direction may be parallel to the carrying direction. According to this printing method, it is possible to improve image quality.

Further, in the above-described printing method, it is preferable to convert the resolution of an image having a predetermined resolution in the first direction and a predetermined resolution in the second direction to obtain the image in which the resolution in the first direction is higher than the resolution in the second direction. According to this printing method, it is possible to give directivity to the resolution of an image through this conversion process. It is then possible to improve image quality even at a low resolution according to the process (edge processing) of the present invention using the directivity in the resolution of the image.

Further, in the above-described printing method, it is preferable that the predetermined resolution in the first direction and the predetermined resolution in the second direction are the same. According to this printing method, it is possible to give directivity to the resolution of an image through this conversion process. It is then possible to improve image quality even at a low resolution according to the process (edge processing) of the present invention using the directivity in the resolution of the image.

Further, in the above-described printing method, it is preferable that adjacent pixels among pixels that structure the image having the predetermined resolution are taken as a unit and regarded as a new pixel to obtain the image in which the resolution in the first direction is higher than the resolution in the second direction. In the above-described printing method, it is also preferable that two adjacent pixels among the pixels that structure the image having the predetermined resolution are taken as a unit and regarded as a new pixel. In the above-described printing method, it is also preferable that adjacent pixels in the second direction among the pixels that structure the image having the predetermined resolution are taken as a unit and regarded as a new pixel. According to this printing method, it is possible to obtain an image having directivity in resolution using a simple conversion process.

Further, in the above-described printing method, it is preferable that an amount of information of pixel data of each of the pixels that structure the image in which the resolution in the first direction is higher than the resolution in the second direction is larger than an amount of information of pixel data of each of the pixels that structure the image having the predetermined resolution. In the above-described printing method, it is also preferable that the amount of information of the pixel data of each of the pixels that structure the image in which the resolution in the first direction is higher than the resolution in the second direction is at least two bits. In the above-described printing method, it is also preferable that the amount of information of the pixel data of each of the pixels that structure the image having the predetermined resolution is one bit. According to this printing method, it is possible to give directivity to the resolution of an image through this conversion process. It is then possible to improve image quality even at a low resolution according to the process (edge processing) of the present invention using the directivity in the resolution of the image.

Further, in the above-described printing method, it is preferable that the image printed on the medium is an image in which a predetermined region is filled in with the first dots or the second dots. In the above-described printing method, it is also preferable that the position on the medium corresponding to the certain pixel is at an outline section of the predetermined region. According to this printing method, it is possible to print the outline section of a region that is filled in (painted out) by the dots smoothly. Particularly, with this printing method, it is possible to print both slanting outline sections and rounded outline sections smoothly. Since usual images often have an outline in which slanting outline sections and rounded outline sections are continuously connected, the present printing method is particularly advantageous in carrying out high-quality printing.

Further, in the above-described printing method, it is preferable that the image printed on the medium is text. In case of printing text, it is necessary to clearly define the outline sections of the text in order to make the printed text easy to read. Further, text printing often involves printing of slanting outline sections and rounded outline sections, and therefore, it is necessary to clearly define those outline sections. Therefore, according to the above-described printing method, it is possible to print easy-to-read text on a medium.

It is also possible to achieve a printing method for printing, on a medium, an image in which a resolution in a first direction is higher than a resolution in a second direction by forming first dots or second dots that are smaller than the first dots at positions on the medium that correspond to pixels structuring the image, the method comprising the step of forming the second dot at a position on the medium corresponding to a certain pixel if the first dot is to be formed at the position on the medium corresponding to the certain pixel, and at least either one of condition 1 or condition 2 below is met:

condition 1:

neither the first dot nor the second dot is to be formed at a position on the medium corresponding to one adjacent pixel of either two adjacent pixels that are adjacent, in the first direction, to the certain pixel, and neither the first dot nor the second dot is to be formed at positions on the medium corresponding to two pixels that are adjacent, in the second direction, to the one adjacent pixel; or condition 2:

neither the first dot nor the second dot is to be formed at a position on the medium corresponding to the other adjacent pixel of the two adjacent pixels, and neither the first dot nor the second dot is to be formed at positions on the medium corresponding to two pixels that are adjacent, in the second direction, to the other adjacent pixel, wherein:

the first dot has an oval shape that is longer in the second direction than in the first direction;

the first dots and the second dots are formed by a print head;

the print head is movable in a predetermined direction;

the second direction is parallel to the predetermined direction;

the resolution of an image having a predetermined resolution in the first direction and a predetermined resolution in the second direction is converted to obtain the image in which the resolution in the first direction is higher than the resolution in the second direction;

the predetermined resolution in the first direction and the predetermined resolution in the second direction are the same;

two pixels adjacent to each other in the second direction among the pixels that structure the image having the predetermined resolution are taken as a unit and regarded as a new pixel to obtain the image in which the resolution in the first direction is higher than the resolution in the second direction;

an amount of information of pixel data of each of the pixels that structure the image in which the resolution in the first direction is higher than the resolution in the second direction is larger than an amount of information of pixel data of each of the pixels that structure the image having the predetermined resolution;

the amount of information of the pixel data of each of the pixels that structure the image in which the resolution in the first direction is higher than the resolution in the second direction is at least two bits;

the amount of information of the pixel data of each of the pixels that structure the image having the predetermined resolution is one bit;

the image printed on the medium is an image in which a predetermined region is filled in with the first dots or the second dots;

the position on the medium corresponding to the certain pixel is at an outline section of the predetermined region; and the image printed on the medium is text.

According to such a printing method, it is possible to improve image quality.

Another aspect of the present invention is a control method for correlating either first dot information about a first dot or second dot information about a second dot that is smaller than the first dot to each of a plurality of pixels that structure an image in which a resolution in a first direction is higher than a resolution in a second direction, and for outputting the first dot information and the second dot information, the method comprising the step of correlating the second dot information to a certain pixel if the first dot information is correlated to the certain pixel, and at least either one of condition 1 or condition 2 below is met:

condition 1:

neither the first dot information nor the second dot information is correlated to one adjacent pixel of either two adjacent pixels that are adjacent, in the first direction, to the certain pixel, and neither the first dot information nor the second dot information is correlated to two pixels that are adjacent, in the second direction, to the one adjacent pixel; or condition 2:

neither the first dot information nor the second dot information is correlated to the other adjacent pixel of the two adjacent pixels, and neither the first dot information nor the second dot information is correlated to two pixels that are adjacent, in the second direction, to the other adjacent pixel.

According to such a control method, it is possible to improve image quality.

Another aspect of the present invention is a printing apparatus comprising:

a head that is capable of forming, on a medium, first dots and second dots that are smaller than the first dots;

wherein the printing apparatus prints, on the medium, an image in which a resolution in a first direction is higher than a resolution in a second direction by forming the first dots or the second dots at positions on the medium that correspond to pixels structuring the image; and wherein the printing apparatus forms the second dot at a position on the medium corresponding to a certain pixel if the first dot is to be formed at the position on the medium corresponding to the certain pixel, and at least either one of condition 1 or condition 2 below is met:

condition 1:

neither the first dot nor the second dot is to be formed at a position on the medium corresponding to one adjacent pixel of either two adjacent pixels that are adjacent, in the first direction, to the certain pixel, and neither the first dot nor the second dot is to be formed at positions on the medium corresponding to two pixels that are adjacent, in the second direction, to the one adjacent pixel; or condition 2:

neither the first dot nor the second dot is to be formed at a position on the medium corresponding to the other adjacent pixel of the two adjacent pixels, and neither the first dot nor the second dot is to be formed at positions on the medium corresponding to two pixels that are adjacent, in the second direction, to the other adjacent pixel.

According to such a printing apparatus, it is possible to improve image quality.

Another aspect of the present invention is a control apparatus comprising a controller for:

correlating either first dot information about a first dot or second dot information about a second dot that is smaller than the first dot to each of a plurality of pixels that structure an image in which a resolution in a first direction is higher than a resolution in a second direction;

outputting the first dot information and the second dot information; and correlating the second dot information to a certain pixel if the first dot information is correlated to the certain pixel, and at least either one of condition 1 or condition 2 below is met:

condition 1:

neither the first dot information nor the second dot information is correlated to one adjacent pixel of either two adjacent pixels that are adjacent, in the first direction, to the certain pixel, and neither the first dot information nor the second dot information is correlated to two pixels that are adjacent, in the second direction, to the one adjacent pixel; or condition 2:

neither the first dot information nor the second dot information is correlated to the other adjacent pixel of the two adjacent pixels, and neither the first dot information nor the second dot information is correlated to two pixels that are adjacent, in the second direction, to the other adjacent pixel.

According to such a control apparatus, it is possible to improve image quality.

Another aspect of the present invention is a computer-readable storage medium having recorded thereon a computer program for causing a printing apparatus comprising a head that is capable of forming, on a medium, first dots and second dots that are smaller than the first dots to achieve functions of:

printing, on the medium, an image in which a resolution in a first direction is higher than a resolution in a second direction by forming the first dots or the second dots at positions on the medium that correspond to pixels structuring the image; and forming the second dot at a position on the medium corresponding to a certain pixel if the first dot is to be formed at the position on the medium corresponding to the certain pixel, and at least either one of condition 1 or condition 2 below is met:

condition 1:

neither the first dot nor the second dot is to be formed at a position on the medium corresponding to one adjacent pixel of either two adjacent pixels that are adjacent, in the first direction, to the certain pixel, and neither the first dot nor the second dot is to be formed at positions on the medium corresponding to two pixels that are adjacent, in the second direction, to the one adjacent pixel; or condition 2:

neither the first dot nor the second dot is to be formed at a position on the medium corresponding to the other adjacent pixel of the two adjacent pixels, and neither the first dot nor the second dot is to be formed at positions on the medium corresponding to two pixels that are adjacent, in the second direction, to the other adjacent pixel.

According to such a computer program, it is possible to improve image quality.

Another aspect of the present invention is a computer-readable storage medium having recorded thereon a computer program for causing a control apparatus comprising a controller to achieve functions of:

correlating either first dot information about a first dot or second dot information about a second dot that is smaller than the first dot to each of a plurality of pixels that structure an image in which a resolution in a first direction is higher than a resolution in a second direction;

outputting the first dot information and the second dot information; and correlating the second dot information to a certain pixel if the first dot information is correlated to the certain pixel, and at least either one of condition 1 or condition 2 below is met:

condition 1:

neither the first dot information nor the second dot information is correlated to one adjacent pixel of either two adjacent pixels that are adjacent, in the first direction, to the certain pixel, and neither the first dot information nor the second dot information is correlated to two pixels that are adjacent, in the second direction, to the one adjacent pixel; or condition 2:

neither the first dot information nor the second dot information is correlated to the other adjacent pixel of the two adjacent pixels, and neither the first dot information nor the second dot information is correlated to two pixels that are adjacent, in the second direction, to the other adjacent pixel.

According to such a computer program, it is possible to improve image quality.

===Configuration of Printing System===

<Overall Configuration>

An embodiment of a printing system (computer system) is described below with reference to the drawings. The description of the present embodiment below, however, also includes embodiments of a computer program, a computer-readable storage medium having a computer program recorded thereon, etc.

FIG. 1 is an explanatory diagram showing an external configuration of the printing system. The printing system 1000 includes a printer 1, a computer 1100, a display device 1200, an input device 1300, and a record-and-playback device 1400. The printer 1 is a printing apparatus for printing images on media such as paper, cloth, and film. The computer 1100 is electrically connected to the printer 1 and outputs to the printer 1 print data, which corresponds to an image to be printed, for causing the printer 1 to print the image. The display device 1200 has a display and causes it to display a user interface for an application program, a printer driver, etc. The input device 1300 includes, for example, a keyboard 1300A and a mouse 1300B, and is used for operating the application program or for setting the printer driver, for example, according to the user interface displayed on the display device 1200. The record-and-playback device 1400 includes, for example, a flexible disk drive device 1400A and a CD-ROM drive device 1400B.

The computer 1100 has the printer driver installed therein. The printer driver is a program that achieves the function of causing the display device 1200 to display the user interface as well as the function of converting image data that has been output from the application program into the print data. The printer driver is recorded on a storage medium (computer-readable storage medium) such as a flexible disk FD or a CD-ROM. The printer driver may also be downloaded to the computer 1100 via the Internet. It should be noted that this program is made up of codes for achieving the various functions.

It should be noted that the term "printing apparatus" refers to the printer 1 in a narrow sense, but refers to a system including the printer 1 and the computer 1100 in a broad sense.

<Printer Driver>

Figure 2:
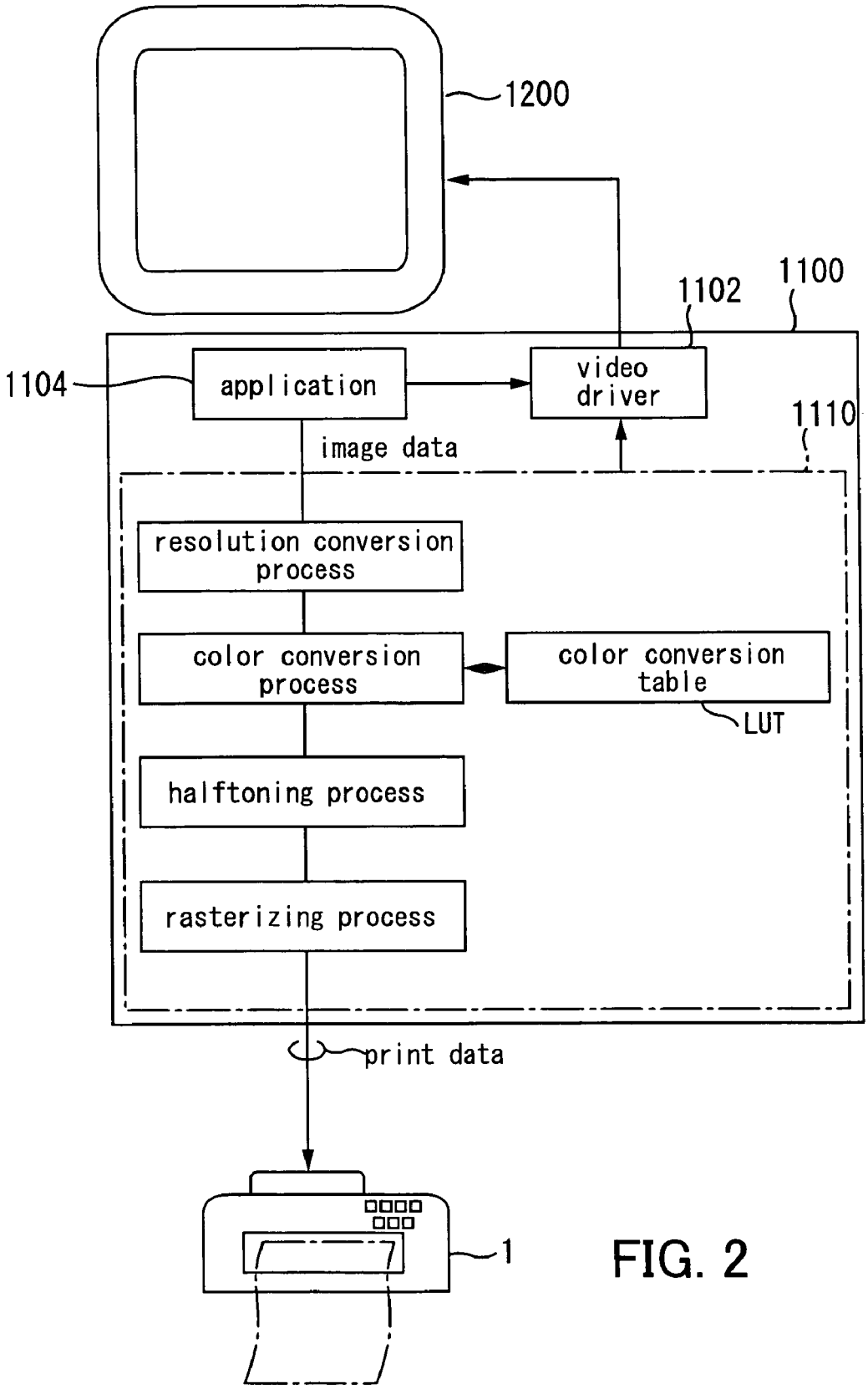
FIG. 2 is an explanatory diagram illustrating processes performed by a printer driver.

FIG. 2 is a schematic explanatory diagram illustrating basic processes performed by the printer driver. The structural components that have already been explained are accompanied with the same reference characters, and thus, description thereof is omitted.

In the computer 1100, computer programs such as a video driver 1102, the application program 1104, and the printer driver 1110 run under an operating system that is installed to the computer 1100. The video driver 1102 has the function of displaying, for example, the user interface on the display device 1200 according to display commands sent from the application program 1104 and/or the printer driver 1110. The application program 1104 has the function of, for example, editing images, and generates data about an image (image data). A user can give instructions, via the user interface of the application program 1104, to print an image that has been edited by the application program 1104. When the application program 1104 receives a print instruction, it outputs image data to the printer driver 1110.

The printer driver 1110 receives the image data from the application program 1104 and converts the image data into print data. The "print data" is data that is in a format that can be interpreted by the printer 1 and that includes various commands and data about pixels (pixel data).

In order to convert the image data, which has been output from the application program 1104, into the print data, the printer driver 1110 carries out processes such as a resolution conversion process, a color conversion process, a halftoning process, and a rasterizing process. The various processes carried out by the printer driver 1110 are described below.

The resolution conversion process is for converting the resolution of the image data (text data, image data, etc.) that has been output from the application program 1104 into the resolution for printing on paper. For example, if the resolution for printing an image on paper is designated to be 720×720 dpi, then the image data received from the application program 1104 is converted into image data having a resolution of 720×720 dpi. It should be noted that the image data that has been subjected to the resolution conversion process is still RGB data in multi-levels (for example, 256 levels of gray) expressed in the RGB color space. Below, the RGB data that is obtained by subjecting the image data to the resolution conversion process is referred to as "RGB image data".

The color conversion process is for converting the RGB data into CMYK data that is expressed in the CMYK color space. It should be noted that the CMYK data corresponds to the colors of inks provided for the printer. The color conversion process is carried out by the printer driver 1110 referring to a table (color conversion lookup table LUT) that correlates the gray-level values of RGB image data and the gray-level values of CMYK image data. According to this color conversion process, the RGB data for each pixel is converted into CMYK data, which corresponds to the ink colors. It should be noted that the data that has been subjected to the color conversion process is 256-level CMYK data that is expressed in the CMYK color space. Below, the CMYK data that is obtained by subjecting the RGB image data to the color conversion process is referred to as "CMYK image data".

The halftoning process is for converting the data with a high number of levels of gray into data with a number of levels of gray that is printable with the printer. With halftoning processing, for example, data indicating 256 levels of gray is converted into 1-bit pixel data indicating 2 levels of gray or 2-bit pixel data indicating 4 levels of gray. According to the halftoning process, dithering, γ-correction, or error diffusion, for example, is used to generate image data that enables the printer to form dots dispersedly. As regards the halftoning process, the printer driver 1110 refers to a dither table 20 when it uses dithering, it refers to a gamma table 24 when it uses γ-correction, and it refers to an error memory 22 for storing diffused error when it uses error diffusion. Data that has been subjected to the halftoning process has a resolution that is the same as that of the RGB data described above (for example, 720×720 dpi), but is, for example, made up of data of one bit per pixel or two bits per pixel. Below, data that has been subjected to the halftoning process and that has one bit per pixel is referred to as "binary data", and data that has been subjected to the halftoning process and that has two bits per pixel is referred to as "multi-value data".

The rasterizing process is for changing the image data which is in a matrix into the data order in which it should be transferred to the printer. Data that has been subjected to the rasterizing process is output to the printer as pixel data included in the print data.

Figure 3:
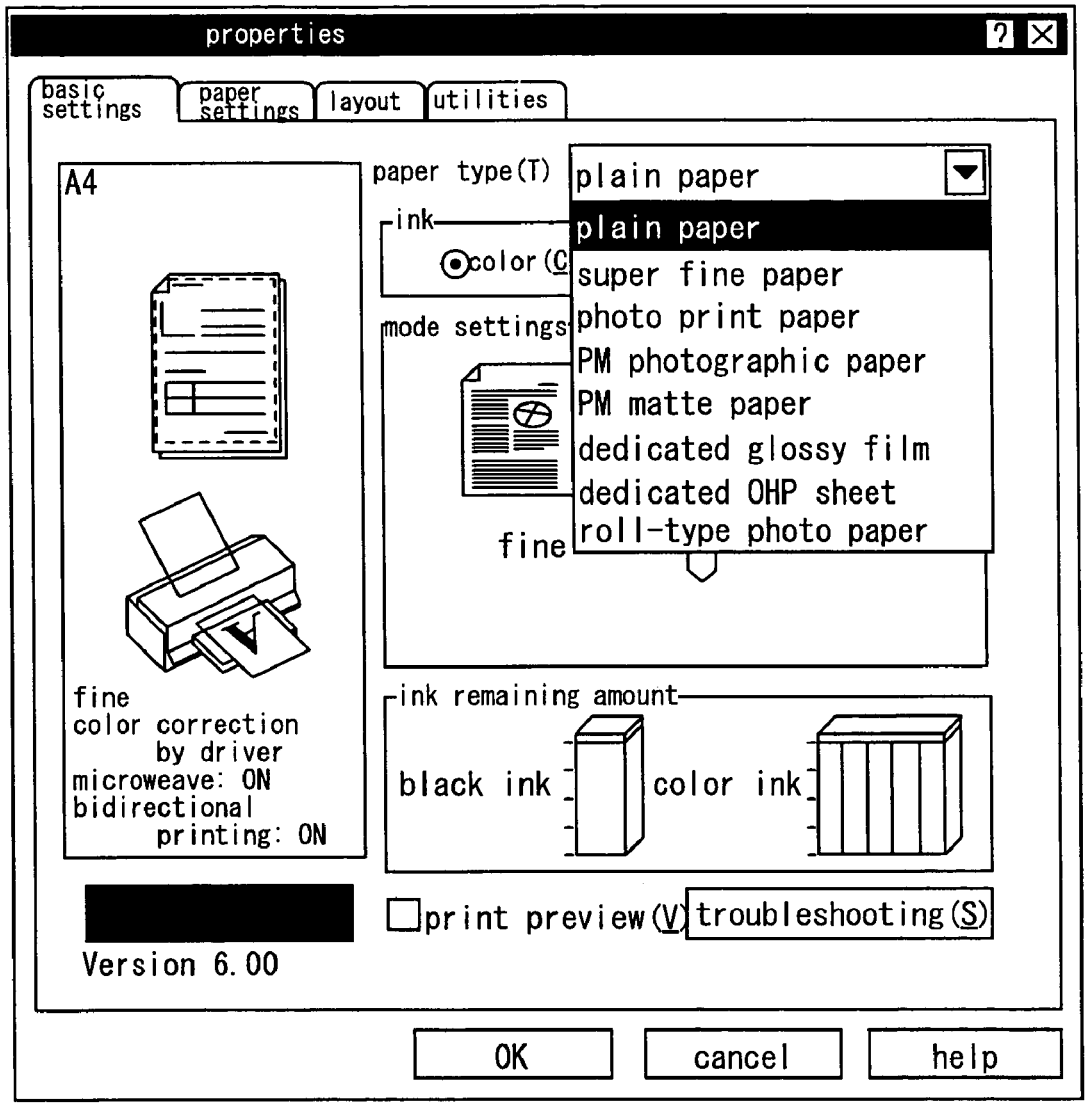
FIG. 3 is an explanatory diagram showing a user interface of the printer driver.

FIG. 3 is an explanatory diagram showing a user interface of the printer driver. The user interface of the printer driver is displayed on the display device via the video driver 1102. The user can carry out various settings of the printer driver using the input device 1300.

The use can select the print mode through this screen. For example, the user can select the high-speed print mode or the fine print mode as the print mode. The printer driver then converts the image data into print data so that the format of the data corresponds to the selected print mode.

The-user can also select the print resolution (the space between dots for printing) through this screen. For example, the user can select, through this screen, 720 dpi or 360 dpi as the print resolution. The printer driver then carries out the resolution conversion process in accordance with the selected resolution to convert the image data into print data.

The user can also select the type of print paper to be used for printing through this screen. For example, the user can select plain paper or glossy paper as the print paper. If the type of paper (paper type) is different, then the way ink spreads (smears) and dries will differ, and thus, the amount of ink appropriate for printing will differ. For this reason, the printer driver converts the image data into the print data in accordance with the selected paper type.

In this way, the printer driver converts image data into print data according to conditions that have been set through the user interface. It should be noted that, through this screen, not only can the user carry out various settings of the printer driver, but he/she can also get hold of the remaining amount of ink in the cartridge, for example.

===Configuration of Printer===

<Configuration of Inkjet Printer>

Figure 4:
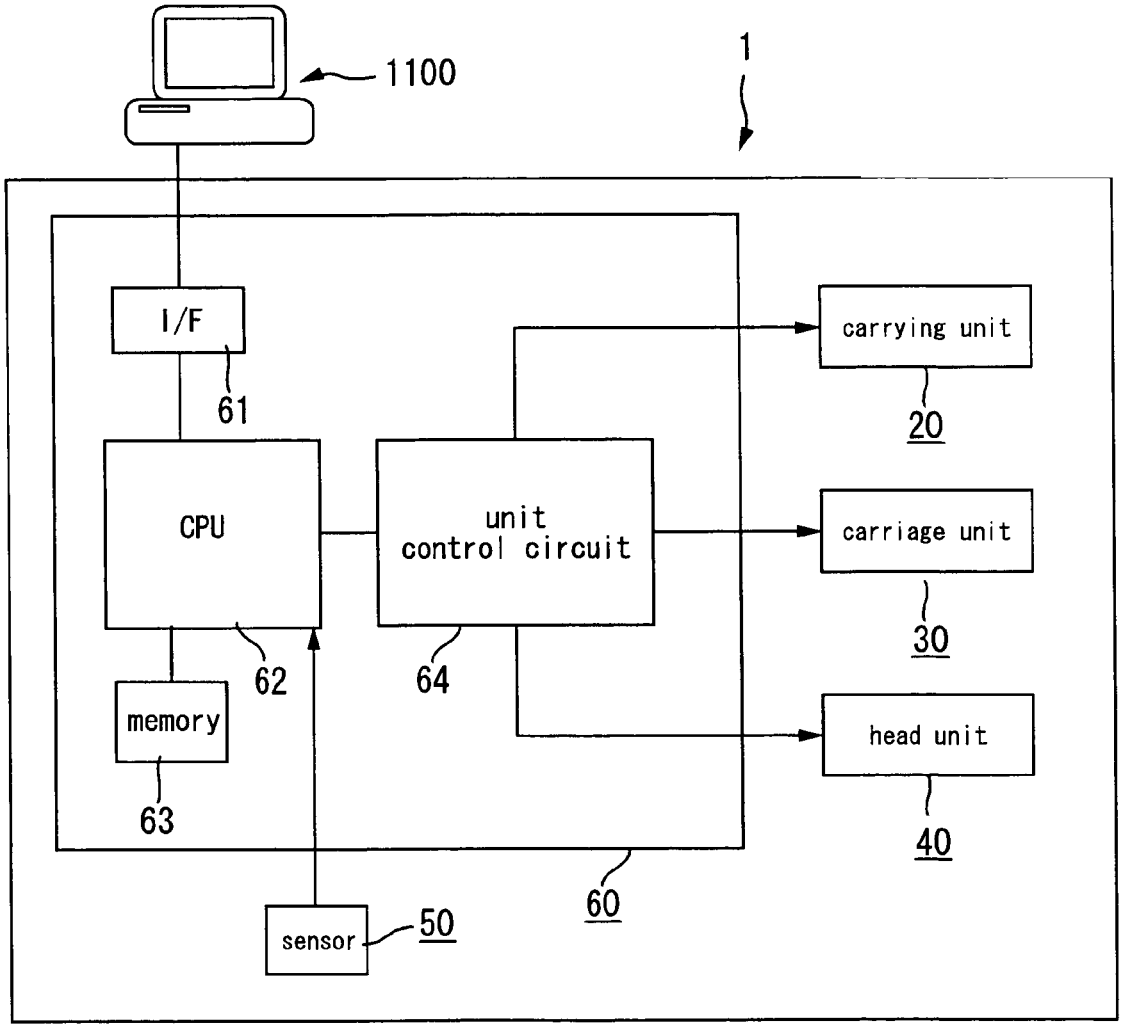
FIG. 4 is a block diagram showing an overall configuration of a printer according to one embodiment.
Figure 5:
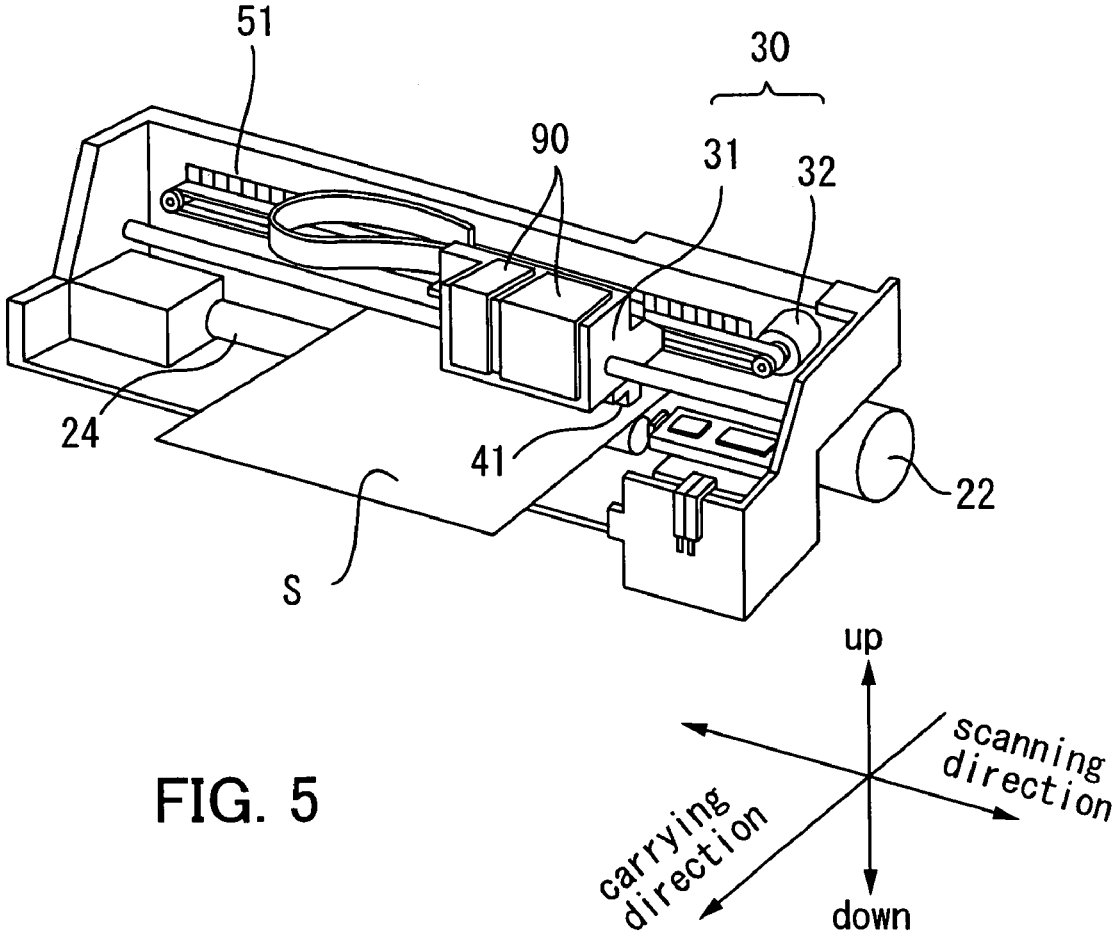
FIG. 5 is a schematic diagram showing an overall configuration of the printer of the present embodiment.
Figure 6:
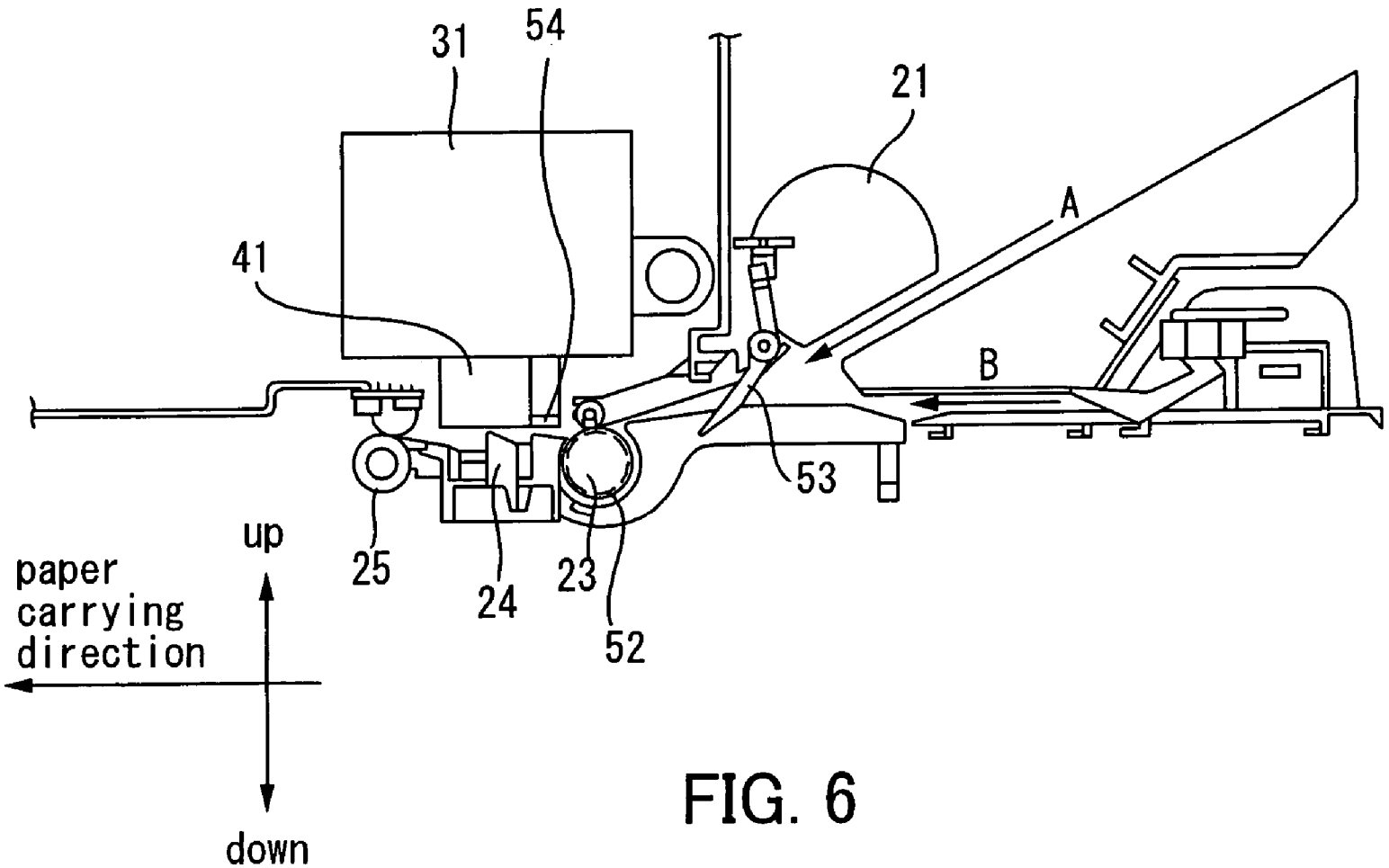
FIG. 6 is an explanatory diagram showing the periphery of a carrying unit of the printer of the present embodiment.

A basic configuration of a printer of the present embodiment is described with reference to FIG. 4, FIG. 5, and FIG. 6. FIG. 4 is a block diagram showing an overall configuration of a printer of the present embodiment. FIG. 5 is a schematic diagram showing an overall configuration of the printer of the present embodiment. FIG. 6 is an explanatory diagram showing the periphery of a carrying unit of the printer of the present embodiment.

The inkjet printer of the present embodiment includes a carrying unit 20, a carriage unit 30, a head unit 40, a sensor 50, and a controller 60. The printer 1 that has received print data from the computer 1100, which is an external device, controls each of the units (i.e., the carrying unit 20, the carriage unit 30, and the head unit 40) using the controller 60. Based on the print data received from the computer 1100, the controller 60 controls each of the units to form an image on paper. The condition inside the printer 1 is monitored by the sensor 50, and the sensor 50 outputs the detection results to the controller 60. Having received the detection results from the sensor 50, the controller 60 controls each of the units based on the detection results.

The carrying unit 20 is for feeding a medium (such as paper S) to a printable position and for carrying the paper at a predetermined carry amount in a predetermined direction (referred to as "carrying direction" below) upon printing. That is, the carrying unit 20 functions as a carrying mechanism (carrying means) for carrying paper. The carrying unit 20 includes a paper supply roller 21, a carrying motor 22 (also referred to as "PF motor"), a carrying roller 23, a platen 24, and a paper discharge roller 25. However, not all of these structural components are necessary for the carrying unit 20 to function as a carrying mechanism. The paper supply roller 21 is for automatically supplying, into the printer, paper that been inserted into a paper insertion opening. The paper supply roller 21 has a D-shaped section, and the length of its circumferential section is set longer than the carrying distance up to the carrying roller 23, and therefore, it is possible to carry the paper up to the carrying roller 23 using this circumferential section. The carrying motor 22 is for carrying the paper in the carrying direction, and is structured of a DC motor. The carrying roller 23 is for carrying the paper S, which has been supplied by the paper supply roller 21, up to a printable region, and is driven by the carrying motor 22. More specifically, when the carrying motor 22 rotates for a predetermined drive amount, the carrying roller 23 rotates for a predetermined amount of rotation, and thus the paper S is carried for a carry amount according to the amount of rotation of the carrying roller 23. The platen 24 supports the paper S that is being printed. The paper discharge roller 25 is for discharging, out from the printer, the paper S for which printing has finished. The paper discharge roller 25 rotates in synchronism with the carrying roller 23.

The carriage unit 30 is for causing a head to move (scan) in a predetermined direction (referred to as "scanning direction" below). The carriage unit 30 includes a carriage 31 and a carriage motor 32 (also referred to as "CR motor). The carriage 31 can move back and forth in the scanning direction. (Accordingly, the head moves in the scanning direction.) Further, the carriage 31 holds ink cartridges, which are for containing ink, in an attachable/detachable manner. The carriage motor 32 is for moving the carriage 31 in the scanning direction, and is structured of a DC motor.

The head unit 40 is for ejecting ink onto paper. The head unit 40 includes a head 41. The head 41 includes a plurality of nozzles, which are ink ejecting sections, and intermittently ejects ink from each of the nozzles. The head 41 is provided on the carriage 31. Therefore, when the carriage 31 moves in the scanning direction, the head 41 also moves in the scanning direction. By intermittently ejecting ink while the head 41 is moving in the scanning direction, dot lines (raster lines) in the scanning direction are formed on the paper.

The sensor 50 includes, for example, a linear encoder 51, a rotary encoder 52, a paper detection sensor 53, and a paper width sensor 54. The linear encoder 51 is for detecting the position, in the scanning direction, of the carriage 31. The rotary encoder 52 is for detecting the amount of rotation of the carrying roller 23. The paper detection sensor 53 is for detecting the position of the front end of the paper to be printed. The paper detection sensor 53 is provided at a position where it can detect the position of the front end of the paper as the paper is being supplied by the paper supply roller 21 toward the carrying roller 23. It should be noted that the paper detection sensor 53 is a mechanical sensor that detects the front end of the paper through a mechanical mechanism. More specifically, the paper detection sensor 53 has a lever that can be rotated in the paper carrying direction, and this lever is arranged so that it protrudes into the path over which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 31. The paper width sensor 54 is an optical sensor and detects whether paper exists or not by detecting, using a light receiving section, light that has been emitted from a light emitting section onto the paper and that is reflected therefrom. The paper width sensor 54 detects the position of the edges of the paper while being moved by the carriage 31, so as to detect the width of the paper. The paper width sensor 54 can also detect the front end of the paper in certain situations. The paper width sensor 54 is an optical sensor, and therefore, it can detect positions with higher precision than the paper detection sensor 53.

The controller 60 is a control unit (controlling means) for controlling the printer. The controller 60 includes an interface section 61, a CPU 62, a memory 63, and a unit control circuit 64. The interface section 61 is for achieving data exchange between the printer 1 and the computer 1100, which is an external device. The CPU 62 is a processor for carrying out overall control of the printer. The memory 63 is for reserving an area for storing the programs for the CPU 62 and a working area, for instance, and has storage means such as a RAM or an EEPROM. The CPU 62 controls each of the units via the unit control circuit 64 in accordance with the programs stored in the memory 63.

The printer of the present embodiment forms dots on a medium to print an image thereon by alternately repeating a carrying step of carrying paper in the carrying direction using the carrying unit 20, and an ink ejecting step of ejecting ink using the head unit 40 while moving the head 41 in the scanning direction using the carriage unit 30.

<Nozzles>

Figure 7:
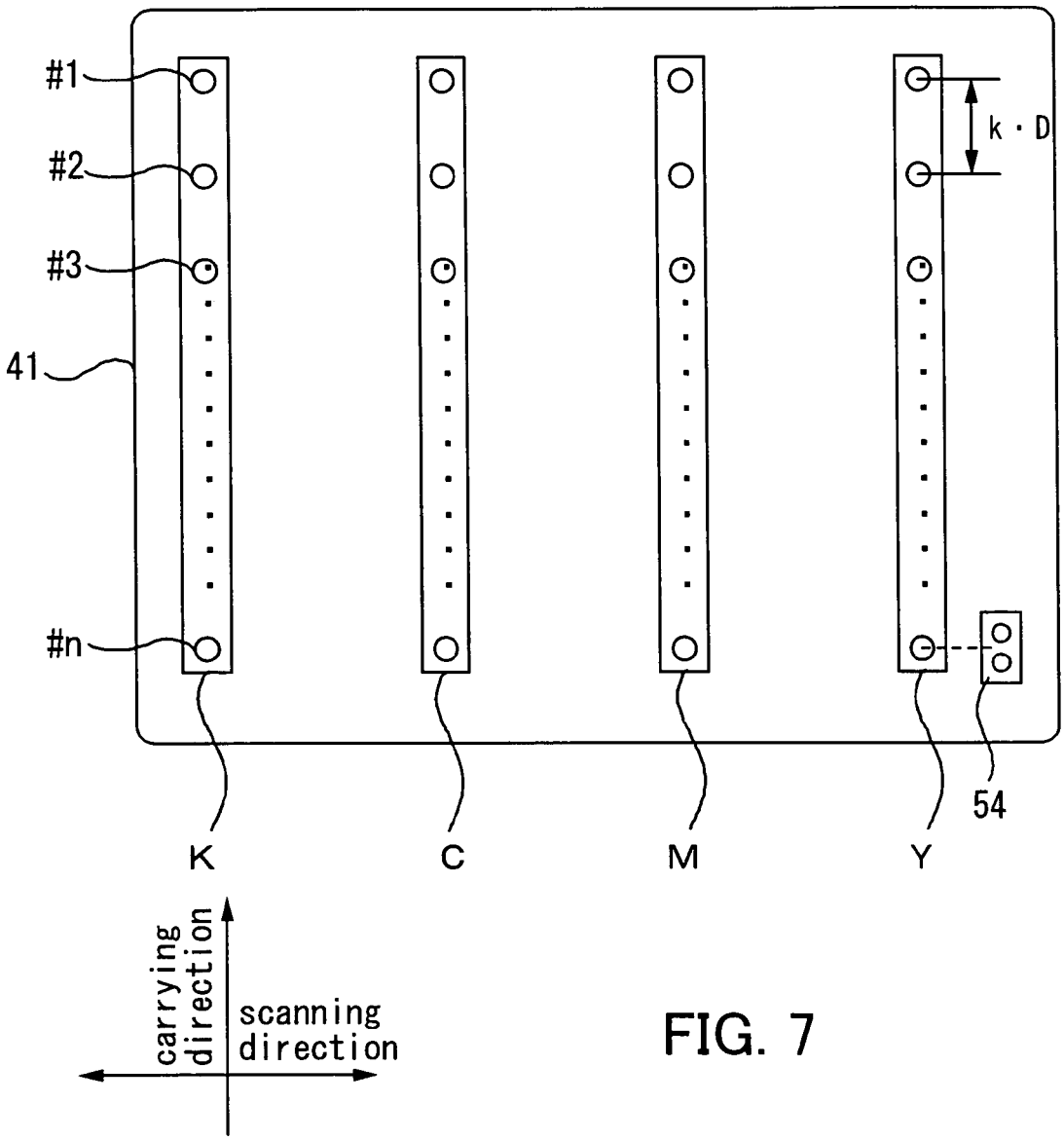
FIG. 7 is an explanatory diagram showing an arrangement of nozzles.

FIG. 7 is an explanatory diagram showing an arrangement of nozzles on the bottom surface of the head 41. A black ink nozzle group K, a cyan ink nozzle group C, a magenta ink nozzle group M, and a yellow ink nozzle group Y are formed in the bottom surface of the head 41. Each nozzle group includes a plurality of nozzles (n nozzles in the present embodiment), which serve as ejection openings for ejecting ink of each color.

The nozzles in each nozzle group are arranged in a row in the carrying direction at a constant interval (nozzle pitch k.D). Here, D is the minimum dot pitch in the carrying direction (i.e., the interval between dots formed on the paper S at the highest resolution), and k is an integer of one or more. For example, if the nozzle pitch is 180 dpi (1/180 inch) and the dot pitch in the carrying direction is 720 dpi (1/720 inch), then k=4.

Among the nozzles in each nozzle group, nozzles arranged further downstream are accompanied with smaller numbers (#1 through #n). That is, nozzle #1 is positioned more downstream in the carrying direction than nozzle #n. Further, as regards the position in the paper carrying direction of the paper width sensor 54, it is arranged almost at the same position as the n-th nozzle #n, which is positioned furthest downstream. Each nozzle is provided with a piezoelectric element (not shown) which serves as a drive element for driving each nozzle and causing it to eject ink droplets.

<Driving the Head>

Figure 8:
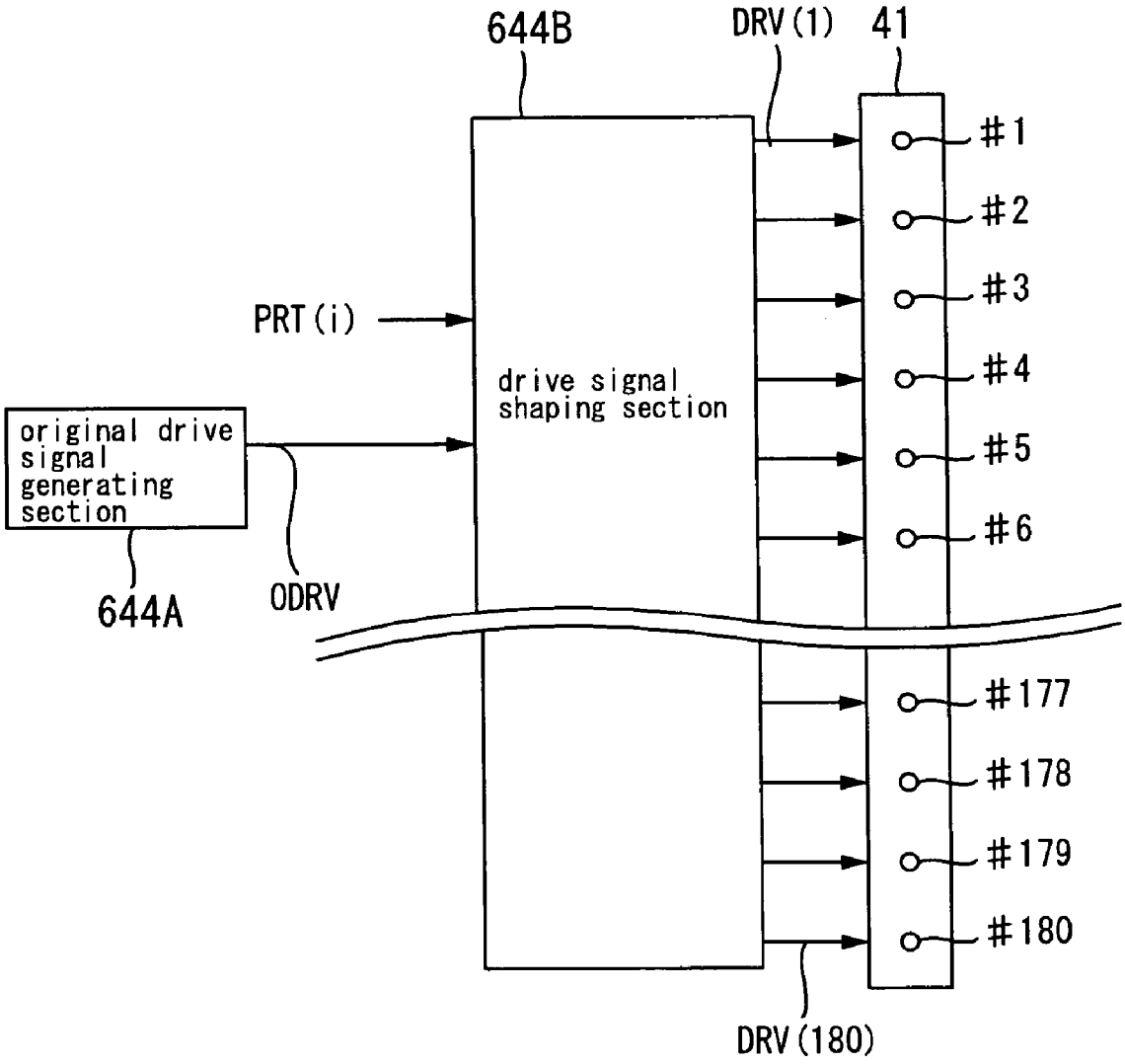
FIG. 8 is an explanatory diagram of a drive circuit of a head unit.

FIG. 8 is an explanatory diagram of a drive circuit of the head unit 40. The drive circuit is provided in the unit control circuit 64 described above, and as shown in the figure, it includes an original drive signal generating section 644A and a drive signal shaping section 644B. In the present embodiment, a drive circuit for the nozzles #1 through #180 is provided for each nozzle group, i.e., for each nozzle group for each color of black (K), cyan (C), magenta (M), and yellow (Y), and the piezoelectric elements are driven separately for each nozzle group. The number shown in parentheses attached to the end of each signal name in the figure indicates the number of the nozzle to which the signal is supplied.

When a voltage having a predetermined time width is applied between electrodes provided on both ends of the piezoelectric element, the element expands according to the amount of time for which the voltage is applied, thereby deforming the side walls of the passage through which the ink flows. Accordingly, the volume of the ink flow passage decreases according to the expansion of the piezoelectric element, and an amount of ink equal to the amount of volume decrease is ejected, as an ink droplet, from each nozzle #1 through #180 for each color.

The original drive signal generating section 644A generates original signals ODRV that are used in common among the nozzles #1 through #180. The original signal ODRV is a signal that includes a plurality of pulses in a main scan period for one pixel (i.e., in an amount of time for the carriage 31 to move across the distance for one pixel).

The original signals ODRV from the original drive signal generating section 644A as well as print signals PRT(i) are input to the drive signal shaping section 644B. The drive signal shaping section 644B shapes the original signal ODRV according to the level of the print signal PRT(i), and then outputs the shaped signal as a drive signal DRV(i) to the piezoelectric element of a corresponding nozzle #1 through #180. The piezoelectric element of each nozzle #1 through #180 is driven according to the drive signal DRV output from the drive signal shaping section 644B.

<Drive Signal for the Head>

Figure 9:
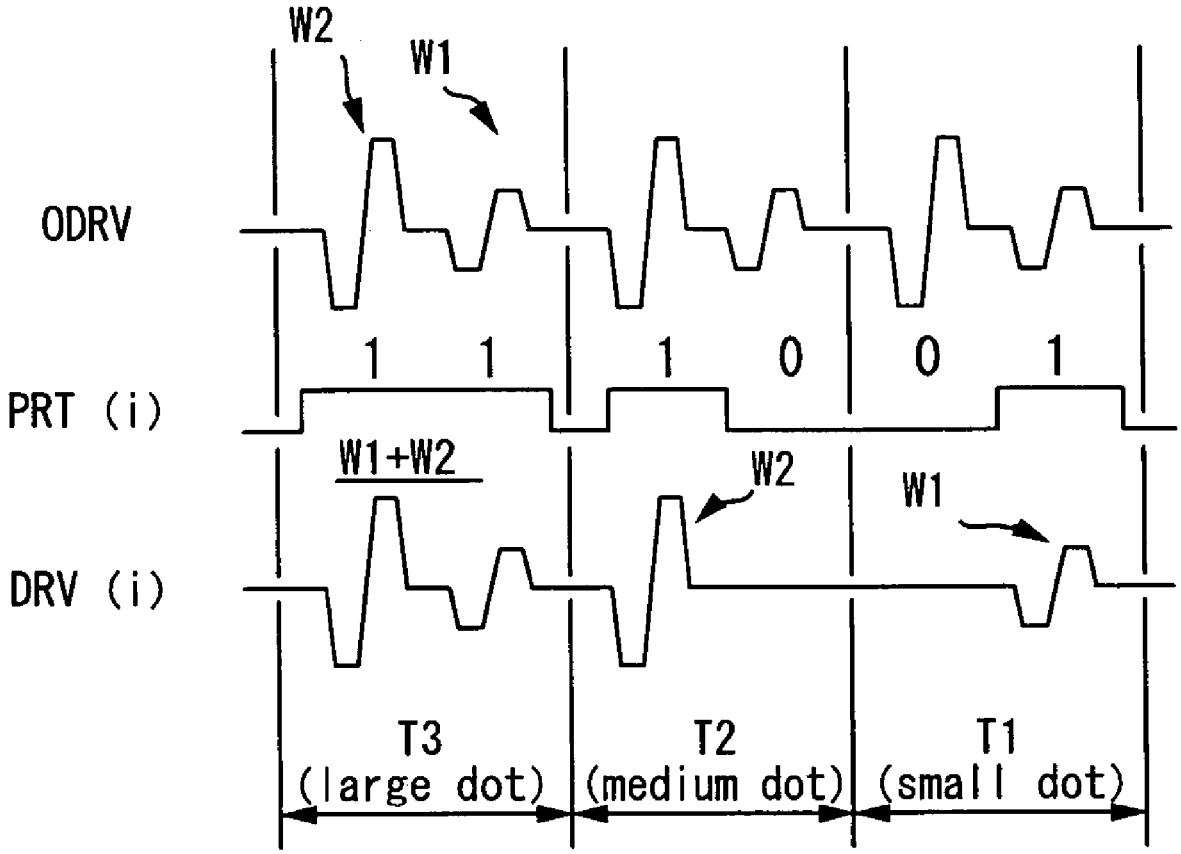
FIG. 9 is a timing chart for illustrating each of the signals.

FIG. 9 is a timing chart for illustrating each of the signals. More specifically, this figure shows timing charts for the original signal ODRV, the print signal PRT(i), and the drive signal DRV(i).

The original signal ODRV is the signal that is supplied in common from the original drive signal generating section 644A to the nozzles #1 through #n. In the present embodiment, the original signal ODRV includes two pulses—a first pulse W1 and a second pulse W2—in a main scan period for one pixel (i.e., in an amount of time for the carriage to move across the distance for one pixel). It should be noted that this original signal ODRV is output from the original drive signal generating section 644A to the drive signal shaping section 644B.

The print signal PRT is a signal that corresponds to the pixel data assigned to one pixel. That is, the print signal PRT corresponds to the pixel data included in the print data. In the present embodiment, the print signal PRT(i) is a signal that includes information with two bits per pixel. It should be noted that the drive signal shaping section 644B shapes the original signal ODRV and outputs a drive signal DRV according to the signal level of the print signal PRT.

The drive signal DRV is a signal obtained by cutting off the original signal ODRV according to the level of the print signal PRT. More specifically, if the print signal PRT is at level 1, then the drive signal shaping section 644B lets the corresponding pulse of the original signal ODRV pass right through as the drive signal DRV. On the other hand, if the print signal PRT is at level 0, then the drive signal shaping section 644B cuts off the pulse of the original signal ODRV. It should be noted that the drive signal shaping section 644B outputs the drive signal DRV to each piezoelectric element provided for each nozzle. The piezoelectric element is then driven according to the drive signal DRV.

When the print signal PRT(i) corresponds to 2-bit data "01", then only the first pulse W1 is output during the first half of one pixel period. Accordingly, a small ink droplet is ejected from the nozzle, and a small dot is formed on the paper. When the print signal PRT(i) corresponds to 2-bit data "10", then only the second pulse W2 is output during the latter half of the pixel period. Accordingly, a medium-sized ink droplet is ejected from the nozzle, and a medium-sized dot (medium dot) is formed on the paper. Further, when the print signal PRT(i) corresponds to 2-bit data "11", then both the first pulse W1 and the second pulse W2 are output during the pixel period. Accordingly, a large ink droplet is ejected from the nozzle, and a large dot is formed on the paper.

As described above, the drive signal DRV(i) for one pixel period is shaped so that its waveform is in one of the three different shapes according to the three different values of the print signal PRT(i).

It should be noted, however, that in the following description, it is assumed that a small dot is formed both when the 2-bit data is "01" and "10", in order to simplify explanation. In other words, the head forms only two types of dots, i.e., large dots and small dots, on the medium.

===Printing Method of the Present Embodiment===

Figure 10:
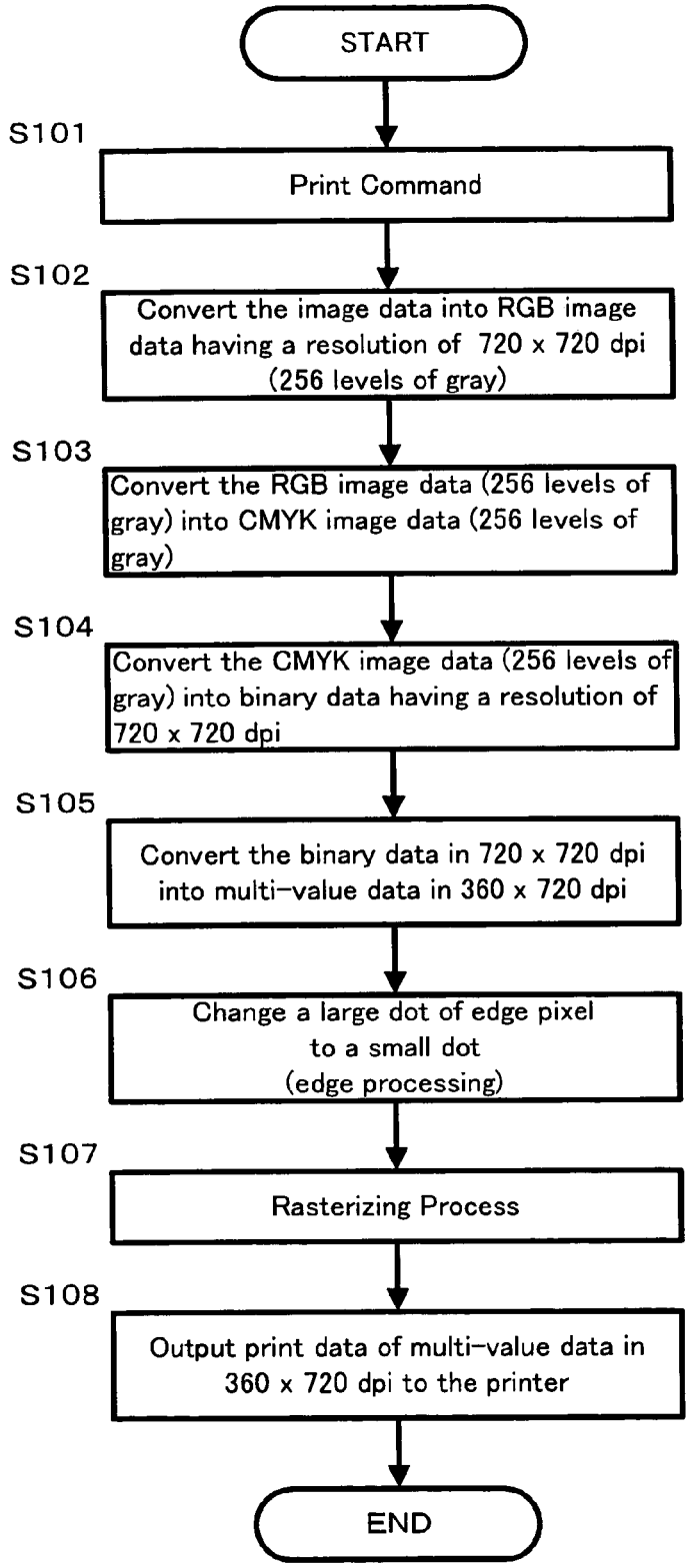
FIG. 10 is a flowchart for illustrating a printing method of the present embodiment.

FIG. 10 is a flowchart for illustrating the printing method of the present embodiment. The various operations described below are carried out by the printer driver. More specifically, the printer driver, which is a program, includes codes for executing the various functions described below. The printing method of the present embodiment features the step of edge processing (S106).

First, the printer driver receives a print command from an application program (S101). The print command is issued by a user instructing printing through the application. The print command includes, for example, image data that has been edited with the application. It should be noted that the printer driver is for converting the image data included in the print command into print data according to the following processes and for outputting the print data to the printer.

Next, the printer driver converts the image data into RGB image data having a resolution of 720×720 dpi, for example (S102: resolution conversion process). As described later on, the printer carries out printing at a resolution of 360×720 dpi in the present embodiment, but in this resolution conversion process, the printer driver converts the image data received from the application program into RGB image data having a resolution higher than the resolution for printing on paper. It should be noted that the RGB image data that has been subjected to the resolution conversion process of the present embodiment is RGB data in 256 levels of gray.

Next, the printer driver converts the RGB image data into CMYK image data (S103: color conversion process). In the present embodiment, the resolution of the RGB image data is 720×720 dpi, so that the resolution of the CMYK image data after being subjected to the color conversion process is also 720×720 dpi. It should be noted that the CMYK image data that has been subjected to the color conversion process of the present embodiment is CMYK data in 256 levels of gray.

Next, the printer driver converts the 256-level CMYK image data into binary data having a resolution of 720×720 dpi (S104: halftoning process). In the present embodiment, the data that has been subjected to the halftoning process is binary data in which 1-bit data is assigned to each pixel.

Figure 11:
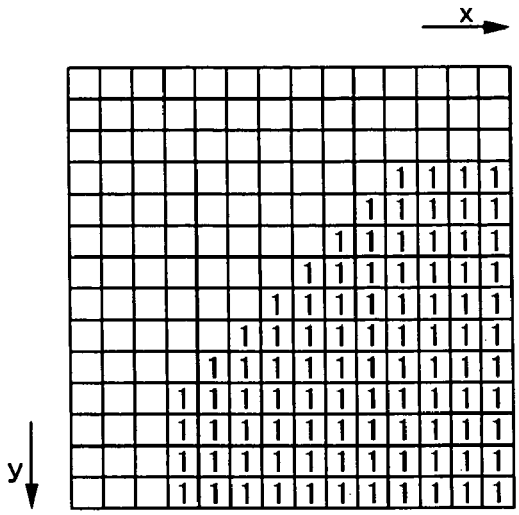
FIG. 11 is an explanatory diagram illustrating binary data that has been subjected to halftoning processing.

FIG. 11 is an explanatory diagram illustrating binary data in 720×720 dpi that has been subjected to halftoning processing. The cells in FIG. 11 are virtual, and each cell indicates a pixel which is the smallest structural unit for configuring an image. In FIG. 11, description is made using an image made up of 14 pixels×14 pixels, in order to simplify explanation. It should be noted that the binary data shown in FIG. 11 is an image having an outline (edge) that is rounded at its upper left.

Binary data of either "0" or "1" is assigned to each pixel. No dot is formed for a pixel to which "0" is assigned; whereas a dot is formed for a pixel to which "1" is assigned. Therefore, the data corresponding to a pixel (pixel data) becomes information about the color of that pixel. (It should be noted that if the printer forms dots based on binary data, then it is only possible to express two levels of gray for each pixel (i.e., "a dot is to be formed" and "a dot is not to be formed") and thus it is not possible to form dots of different sizes.)

Here, pixel data for a pixel positioned at coordinates (x, y) is expressed as f(x, y). For example, when the position of the pixel at the upper left of FIG. 11 is assumed to be (x, y)=(0, 0), then the pixel data for that pixel is f(0, 0)=0. It should be noted that according to this rule, f(13, 13) =1.

Next, the printer driver converts the binary data in 720×720 dpi into multi-value data in 360×720 dpi (S105). More specifically, the printer driver carries out resolution conversion by taking two pixels adjacent to each other in the scanning direction as one unit and regarding this unit as a new pixel. Further, the printer driver correlates a piece of 2-bit data to one new pixel by correlating two pieces of 1-bit data, which have been correlated to the two original pixels, to the new pixel. More specifically, if both pieces of pixel data for the two adjacent pixels are "0", then the printer driver assigns pixel data "00" to the new pixel. If one piece of pixel data for the two adjacent pixels is "0" and the other is "1", then the printer driver assigns pixel data "01" to the new pixel. Further, if both pieces of pixel data for the two adjacent pixels are "1", then the printer driver assigns pixel data "11" to the new pixel. According to this process, the printer driver converts 1-bit data (binary data) in 720×720 dpi into 2-bit data (multi-value data) in 360×720 dpi . Below, this process is referred to as "resolution multi-value conversion process".

According to the resolution multi-value conversion process the printer driver can obtain an image in 360'720 dpi that has directivity in resolution from an image in 720×720 dpi that had no directivity in resolution. Further, according to the resolution multi-value conversion process, the printer driver can obtain multi-value data, which allows dots of different sizes to be formed, from binary data which does not allow dots of different sizes to be formed.

Figure 12:
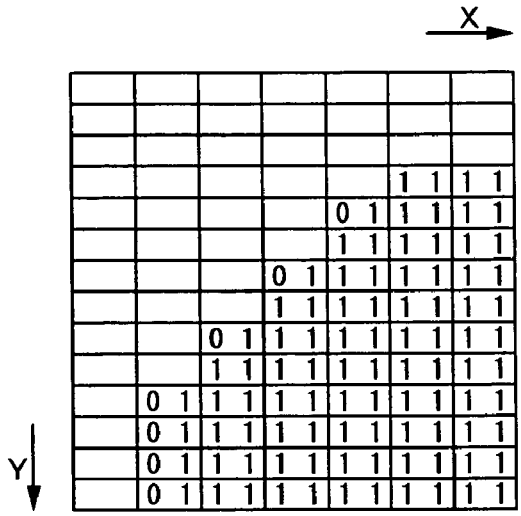
FIG. 12 is an explanatory diagram illustrating multi-value data that has been subjected to resolution multi-value conversion processing.

FIG. 12 is an explanatory diagram illustrating multi-value data in 360×720 dpi that has been subjected to the resolution multi-value conversion process. Since two pixels adjacent to each other in the scanning direction are taken as one unit (new pixel), the pixel shown by each cell in FIG. 12 is rectangular. Therefore, in FIG. 12, the image is made up of 7 pixels×14 pixels. It should be noted that the resolution of the converted data in the scanning direction is 360 dpi, and the resolution in the carrying direction is 720 dpi. In other words, the left/right direction (X direction) in the figure is parallel to the scanning direction, and the up/down direction (Y direction) is parallel to the carrying direction.

Here, pixel data for a pixel positioned at coordinates (X, Y) is expressed as F(X, Y). For example, when the position of the pixel at the upper left of FIG. 12 is assumed to be (X, Y)=(0, 0), then the pixel data for that pixel is F(0, 0)=00. It should be noted that according to this rule, F(6, 13)=11 and F(4, 4)=01.

<When Edge Processing is not Carried Out>

Figure 13:
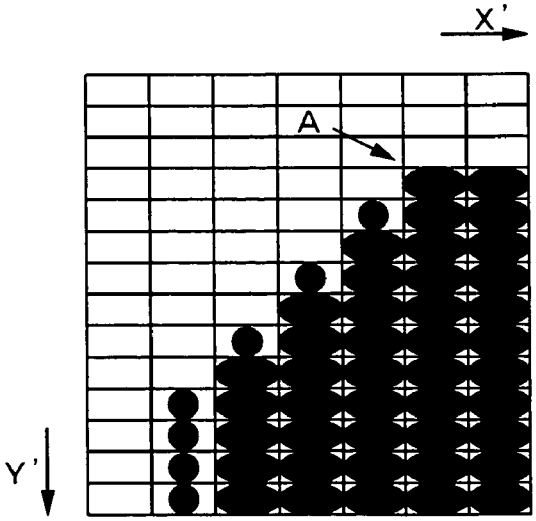
FIG. 13 is an explanatory diagram illustrating how dots are formed when edge processing is not carried out.

FIG. 13 is an explanatory diagram illustrating how dots are formed when edge processing is not carried out. An image such as that shown in the figure will be printed if the printer driver carries out the rasterizing process (S107 in FIG. 10) without carrying out edge processing, the printer driver outputs print data to the printer (S108 in FIG. 10), and the printer carries out printing according to the print data. (The cells in FIG. 13, however, are only virtual cells and are not printed actually.)

When a large dot is formed, a piezoelectric element is driven according to two pulse signals (W1 and W2) and ink is ejected from a nozzle that is moving in the scanning direction, and thus, the large dot has the shape of an oval with a major axis in the scanning direction. It should be noted that the printer does not form a dot at a position on the paper that corresponds to a pixel for which the pixel data is "00". Further, the printer forms a small dot at a position on the paper that corresponds to a pixel for which the pixel data is "01" (or "10"), and forms a large dot at a position on the paper that corresponds to a pixel for which the pixel data is "11".

Here, the position on the paper that corresponds to a pixel positioned at (X, Y) is expressed as (X', Y'). For example, the position on the paper at the upper left in FIG. 13 corresponds to the pixel at the upper left in FIG. 12. Further, a large dot is formed at the position (X', Y')=(6, 13) on the paper, and a small dot is formed at the position (X', Y')=(4, 4) on the paper.

When an image to be printed has a rounded outline (edge) such as a curve, this outline section will not be printed smoothly if edge processing is not carried out. For example, around the arrow A in FIG. 13 (i.e., around (X', Y')=(5, 3)), the outline section is not printed smoothly. That is, if edge processing is not carried out, then the section around the arrow A in FIG. 13 will be printed in such a manner that it protrudes upward (in the −Y' direction) compared to the surrounding outline section, and thus, that section will not have a smooth outline.

<Edge Processing According to Reference Example>

Figure 14:
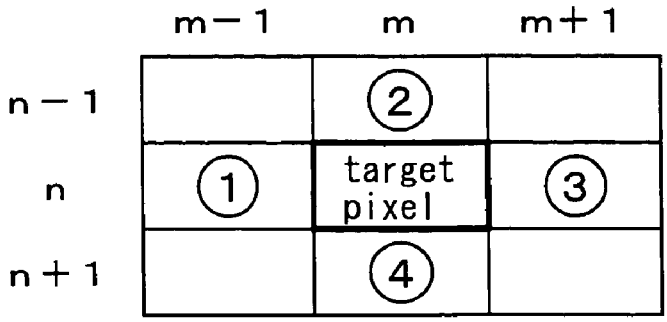
FIG. 14 is an explanatory diagram illustrating edge processing according to a reference example.

FIG. 14 is an explanatory diagram illustrating edge processing according to a reference example.

In the edge processing according to the reference example, the pixel data of a target pixel is changed from to "01" if: the pixel data of the target pixel is "11"; and any one of the pixel data of the pixel (1), the pixel data of the pixel (2), the pixel data of the pixel (3), or the pixel data of the pixel (4) is "00". In other words, in the edge processing according to the reference example, if F(m, n)=11 and at least one of F(m−1, n), F(m, n−1), F(m+1, n), or F(m, n+1) is 00, then F(m, n)=01.

In the edge processing according to the reference example, determination is made about whether a target pixel is to be subjected to edge processing or not based on the amount of change in the X direction and the Y direction of the target pixel using differentiation for a two-dimensional image.

Figure 15:
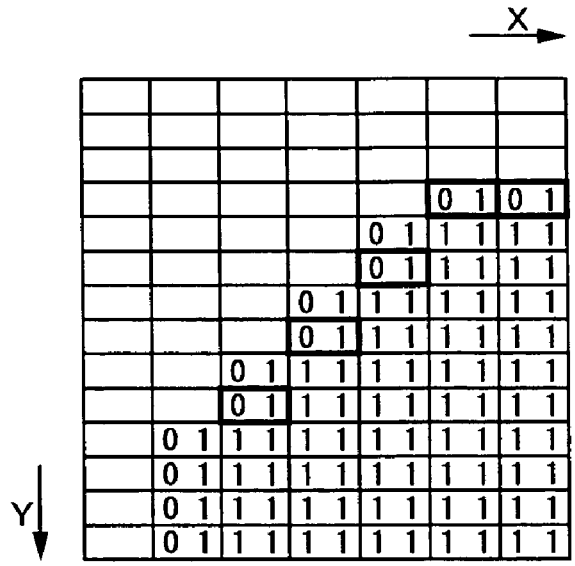
FIG. 15 is an explanatory diagram illustrating multi-value data that has been subjected to the edge processing according to the reference example.

FIG. 15 is an explanatory diagram illustrating multi-value data that has been subjected to the edge processing according to the reference example. In FIG. 15, the pixel data of the pixels surrounded by bold lines are changed from "11" to "01" as a result of the edge processing according to the reference example. That is, the pixel data of the pixels positioned at (X, Y)=(5, 3), (6, 3), (4, 5), (3, 7), and (2, 9) are changed from "11" to "01".

Figure 16:
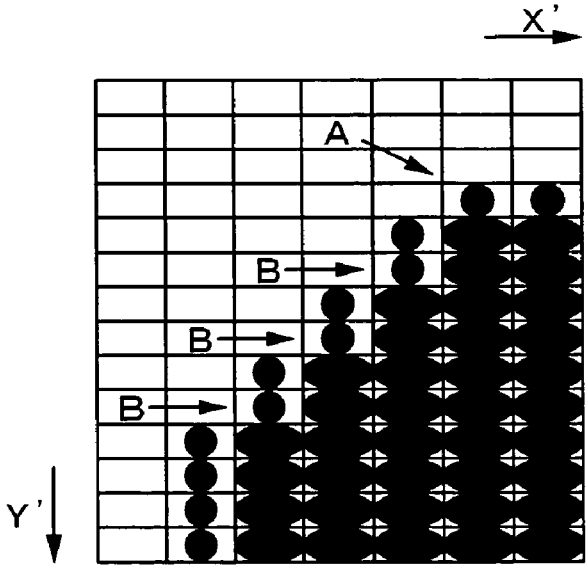
FIG. 16 is an explanatory diagram illustrating how dots are formed after edge processing according to the reference example has been carried out.

FIG. 16 is an explanatory diagram illustrating how dots are formed when edge processing according to the reference example is carried out. Dots such as those shown in the figure will be formed on the paper if the printer driver carries out the edge processing of the reference example (S106 in FIG. 10) and the rasterizing process (S107 in FIG. 10), the printer driver outputs print data to the printer (S108 in FIG. 10), and the printer carries out printing according to the print data. (The cells in FIG. 16, however, are only virtual cells and are not printed actually.)

When the edge processing of the reference example is carried out, the outline section around the arrow A shown in FIG. 16 is smoother and is thus improved, as compared to the example described above in which no edge processing is carried out. As for the edge processing of the reference example, however, if there is a slanting outline, then the outline of that section will not be printed smoothly. For example, around the arrows B in FIG. 16 (i.e., around (X', Y')=(4, 5), (3, 7), and (2, 9)), the slanting outline section is jagged (zigzagged). That is, when the edge processing of the reference example is carried out, the surroundings of the arrows B in FIG. 16 are formed by two small dots adjacent in the carrying direction (Y' direction in FIG. 16), and thus, the outline is not smooth.

<Edge Processing According to the Present Embodiment>

Figure 17:
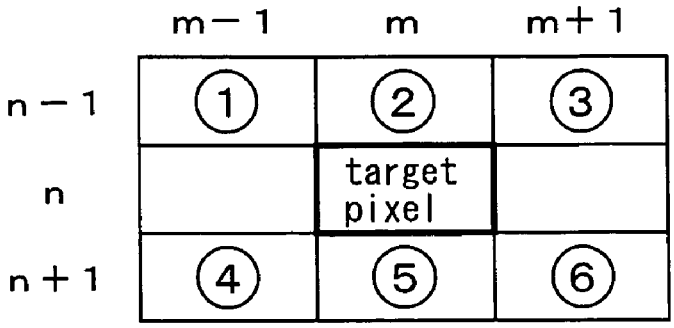
FIG. 17 is an explanatory diagram illustrating edge processing according to the present embodiment.
Figure 18:
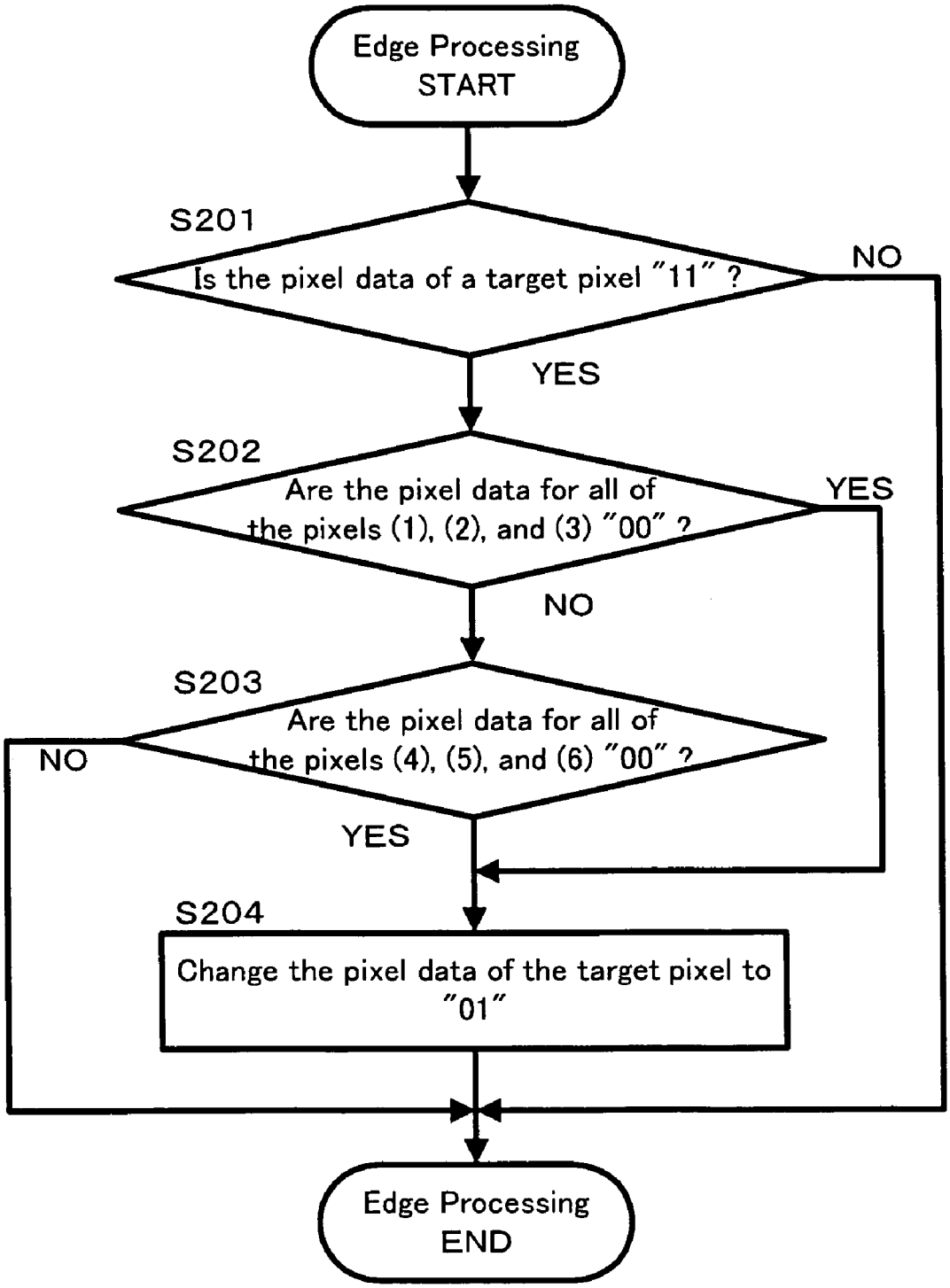
FIG. 18 is a flowchart for illustrating the edge processing according to the present embodiment.

FIG. 17 is an explanatory diagram illustrating edge processing according to the present embodiment. FIG. 18 is a flowchart of the edge processing according to the present embodiment. The various operations described below are carried out by the printer driver. More specifically, the printer driver, which is a program, includes codes for executing the various functions described below.

In the edge processing according to the present embodiment, if the pixel data of a target pixel is "11" (YES at S201), and the target pixel is an "edge pixel" as referred to in the present embodiment (YES at S202 or S203), then the pixel data of the target pixel is changed from "11" to "01" (S204).

A target pixel is regarded as an "edge pixel" if the target pixel meets at least one of the following two conditions:

condition 1: the pixel data for all of the pixel (1), the pixel (2), and the pixel (3) are "00"; or condition 2: the pixel data for all of the pixel (4), the pixel (5), and the pixel (6) are "00".

The conditions 1 and 2 described above can be restated as follows:

condition 1: neither a small dot nor a large dot is formed at the positions on the paper corresponding to the pixel (1), the pixel (2), and the pixel (3); and condition 2: neither a small dot nor a large dot is formed at the positions on the paper corresponding to the pixel (4), the pixel (5), and the pixel (6).

Here, assuming that the position of a target pixel is (X, Y)=(m, n), the positions of the pixels (1) through (6) (reference pixels) are expressed as follows:

pixel (1): $(X, Y)=(m-1, n-1)$ pixel (2): $(X, Y)=(m, n-1)$ pixel (3): $(X, Y)=(m+1, n-1)$ pixel (4): $(X, Y)=(m-1, n+1)$ pixel (5): $(X, Y)=(m, n+1)$ pixel (6): $(X, Y)=(m+1, n+1)$ The positions of the pixels (1) through (6) can be restated as follows:

pixel (1):

the pixel that is adjacent, in the -X direction, to a pixel (pixel (2)) that is adjacent to the target pixel in the −Y direction;

pixel (2):

the pixel that is adjacent to the target pixel in the −Y direction;

pixel (3):

the pixel that is adjacent, in the +X direction, to a pixel (pixel (2)) that is adjacent to the target pixel in the −Y direction;

pixel (4):

the pixel that is adjacent, in the −X direction, to a pixel (pixel (5)) that is adjacent to the target pixel in the +Y direction;

pixel (5):

the pixel that is adjacent to the target pixel in the +Y direction; and pixel (6):

the pixel that is adjacent, in the +X direction, to a pixel (pixel (5)) that is adjacent to the target pixel in the +Y direction.

It should be noted that as regards an image in 360×720 dpi, the X direction is the direction in which the resolution is low, and the Y direction is the direction in which the resolution is high.

The flowchart of FIG. 18 can also be expressed as follows:

$F(m, n)=11?$ S201

$F(m-1, n-1)=00$ AND $F(m, n-1)=00$ AND $F(m+1, n-1)=00?$ S202

$F(m-1, n+1)=00$ AND $F(m, n+1)=00$ AND $F(m+1, n+1)=00?$ S203

$F(m, n)=01$ S204

Figure 19:
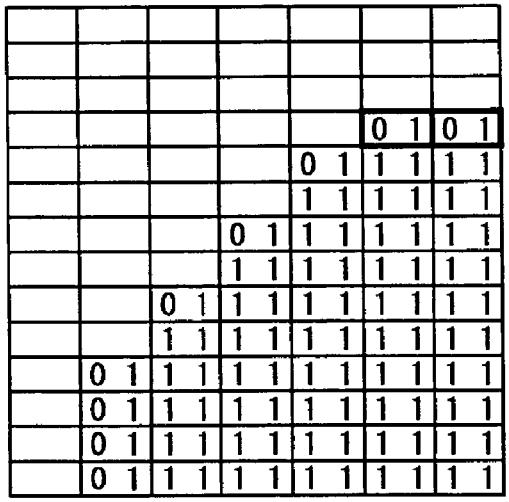
FIG. 19 is an explanatory diagram illustrating multi-value data that has been subjected to the edge processing according to the present embodiment.

FIG. 19 is an explanatory diagram illustrating multi-value data that has been subjected to the edge processing according to the present embodiment. In FIG. 19, the pixel data of the pixels surrounded by bold lines are changed from "11" to "01" as a result of the edge processing according to the present embodiment. That is, the pixel data of the pixels positioned at (X, Y)=(5,3) and (6,3) are changed from "11" to "01". Further, according to the edge processing of the present embodiment, the pixel data of the pixels positioned at (X, Y)=(4, 5), (3, 7), and (2, 9) are not changed, in contrast to the above-described edge processing of the reference example.

Figure 20:
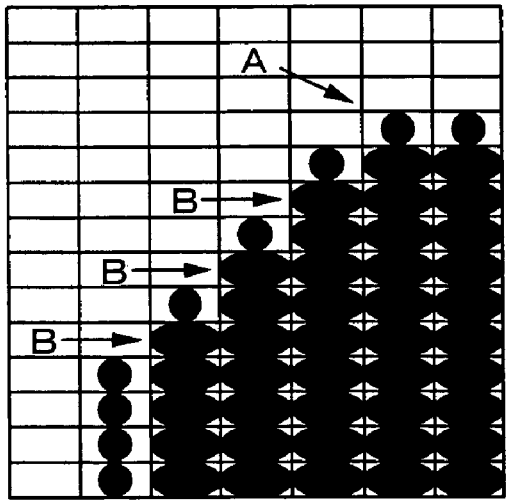
FIG. 20 is an explanatory diagram illustrating how dots are formed when edge processing according to the present embodiment is carried out.

FIG. 20 is an explanatory diagram illustrating how dots are formed when edge processing according to the present embodiment is carried out. Dots such as those shown in the figure will be formed on the paper if the printer driver carries out the edge processing of the present embodiment (S106 in FIG. 10) and the rasterizing process (S107 in FIG. 10), the printer driver outputs print data to the printer (S108 in FIG. 10), and the printer carries out printing according to the print data. (The cells in FIG. 20, however, are only virtual cells and are not printed actually.) When the edge processing of the present embodiment is carried out, the outline section around the arrow A shown in FIG. 20 is smoother and is thus improved, as compared to the example described above in which no edge processing is carried out. Further, also the slanting outline section around the arrows B in FIG. 20 is not jagged (zigzagged), and the outline section becomes smoother and is thus improved, as compared to the reference example described above.

That is, according to the present embodiment, even if an image to be printed has a rounded outline (edge) such as a curve, this outline section can be printed smoothly. Furthermore, according to the present embodiment, even if an image has a slanting outline section, that outline section can also be printed smoothly. Usual images often have an outline in which slanting outline sections and rounded outline sections are continuously connected. Therefore, the edge processing of the present embodiment that allows both the slanting outline sections and the rounded outline sections to be printed smoothly is particularly advantageous in carrying out high-quality printing.

<Directivity of Reference Pixels>

The edge processing according to the present embodiment is targeted for images in which the resolution in the X direction (scanning direction) is low and the resolution in the Y direction (carrying direction) is high. According to this edge processing, when the pixel data for all three reference pixels aligned in the X direction (i.e., the three pixels, pixel (1), pixel (2), and pixel (3), or the three pixels, pixel (4), pixel (5), and pixel (6)) are "00", the printer driver determines that the target pixel is an "edge pixel" and changes the pixel data of the target pixel from "11" to "01".

As it is made clear below, the directivity in resolution and the direction in which the three pixels are aligned are closely related.

Figure 21A:
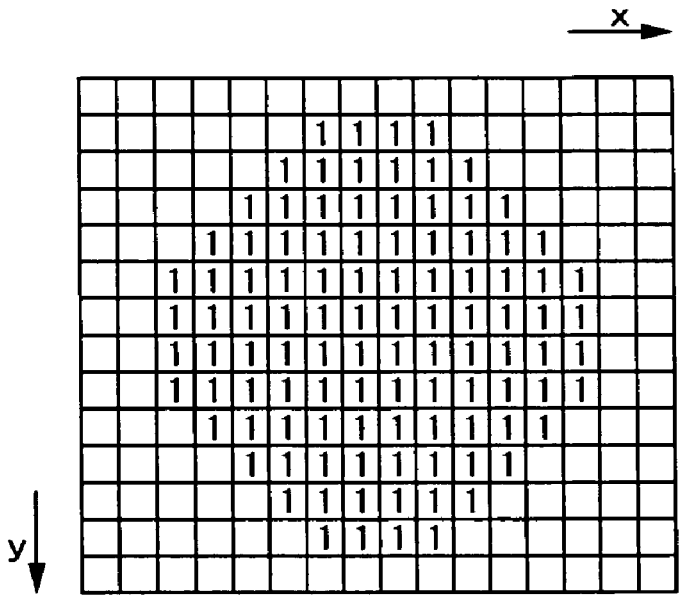
FIG. 21A is an explanatory diagram illustrating binary data that has been subjected to the halftoning process but not to the resolution multi-value conversion process.

FIG. 21A is an explanatory diagram illustrating binary data that has been subjected to the halftoning process but not to the resolution multi-value conversion process. The data has a resolution of 720×720 dpi. In FIG. 21A, description is made using an image made up of 16 pixels×16 pixels, in order to simplify explanation.

Figure 21B:
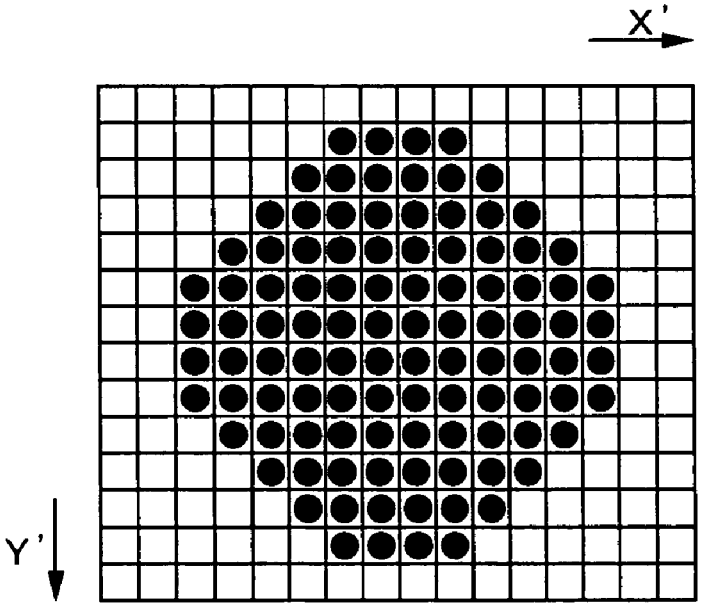
FIG. 21B is an explanatory diagram illustrating how dots are formed when printing is carried out according to the binary data shown in FIG. 21A.

FIG. 21B is an explanatory diagram illustrating how dots are formed when the printer carries out printing at a resolution of 720×720 dpi according to the binary data shown in FIG. 21A. It should be noted that, since the printer forms dots based on binary data, it is only possible to express two levels of gray for each pixel (i.e., "a dot is to be formed" and "a dot is not to be formed") and thus it is not possible to form dots of different sizes.

It is of course preferable to be able to obtain a printed image that looks close to an image printed at a resolution of 720×720 dpi, even when the printer forms dots according to multi-value data in 360×720 dpi that has been subjected to the resolution multi-value conversion process. Below, a comparison is made as to which of either an image printed according to a comparative example or an image printed according to the present embodiment looks closer to an image printed at a resolution of 720×720 dpi.

Figure 22:
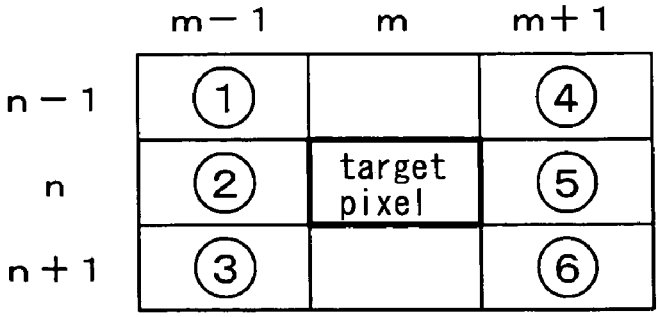
FIG. 22 is an explanatory diagram illustrating edge processing according to a comparative example.

FIG. 22 is an explanatory diagram illustrating edge processing according to a comparative example. In the edge processing of the comparative example, the three reference pixels (i.e., the three pixels, pixel (1), pixel (2), and pixel (3), or the three pixels, pixel (4), pixel (5), and pixel (6)) are aligned not in the X direction (scanning direction) but in the Y direction (carrying direction).

Figure 23A:
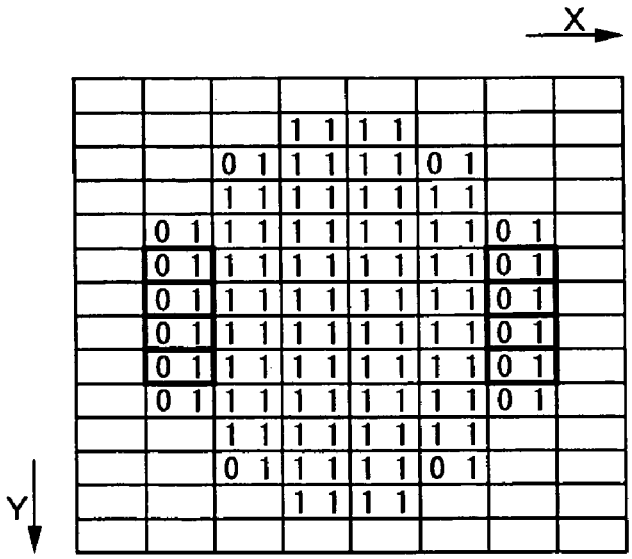
FIG. 23A is an explanatory diagram illustrating multi-value data that has been subjected to the edge processing of the comparative example.
Figure 23B:
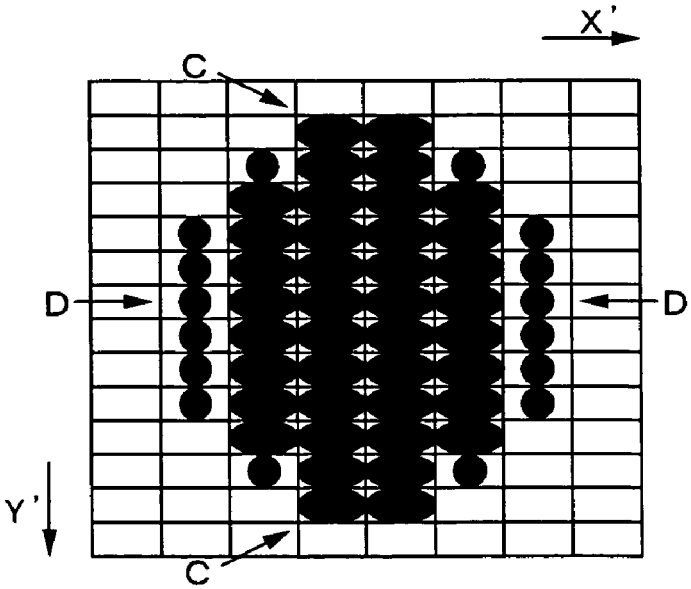
FIG. 23B is an explanatory diagram illustrating how dots are formed according to the comparative example.

FIG. 23A is an explanatory diagram illustrating multi-value data that has been subjected to the edge processing of the comparative example. In FIG. 23A, the pixel data of the pixels surrounded by bold lines are changed from "11" to "01" as a result of the edge processing according to the comparative example. FIG. 23B is an explanatory diagram illustrating how dots are formed when edge processing according to the comparative example is carried out.

Comparison is made between the image formed on the paper at a resolution of 720×720 dpi (FIG. 21B) and the image formed on the paper according to the comparative example (FIG. 23B). The image in FIG. 21B has dimensions equal in both the X' direction and the Y' direction. The image of the comparative example, however, is narrower in the X' direction, and as a whole, the image is extended in the Y' direction. Further, the rounded outline around the arrows C in FIG. 23B is printed in such a manner that it protrudes in the Y' direction, so that the outline is not smooth. Furthermore, at a resolution of 360×720 dpi, the resolution in the X direction is low, so that the dot interval in the X direction is large. Therefore, when small dots and large dots are formed next to each other in the X direction as in the surroundings of the arrows D in FIG. 23B, the space between the dots becomes large, thereby causing the image to become coarse.

Figure 24A:
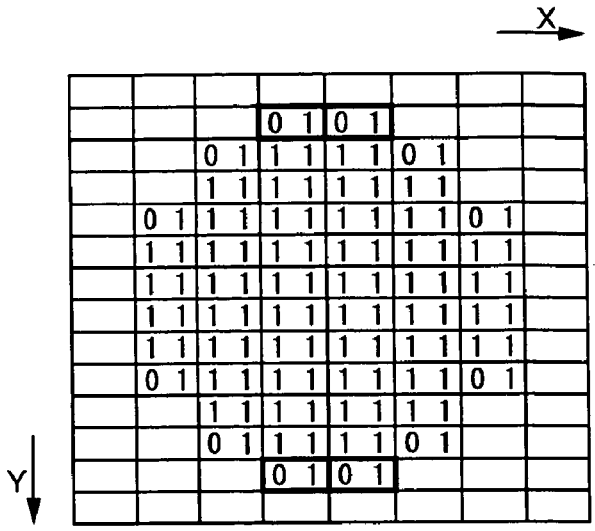
FIG. 24A is an explanatory diagram illustrating multi-value data that has been subjected to the edge processing of the present embodiment.
Figure 24B:
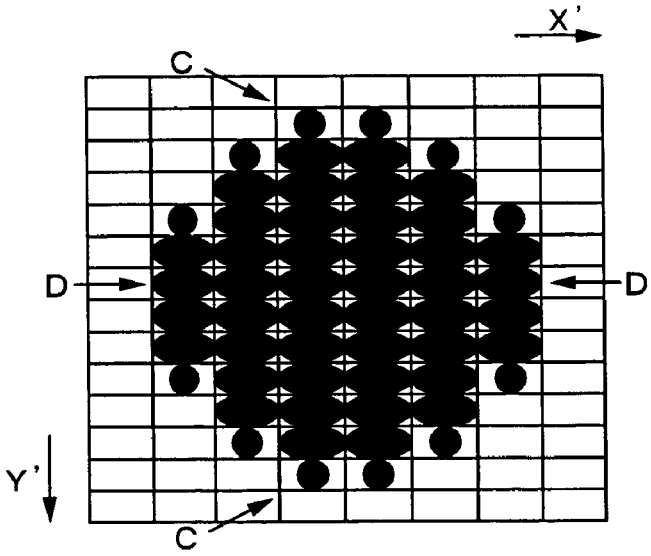
FIG. 24B is an explanatory diagram illustrating how dots are formed according to the present embodiment.

FIG. 24A is an explanatory diagram illustrating multi-value data that has been subjected to the edge processing of the present embodiment. In FIG. 24A, the pixel data of the pixels surrounded by bold lines are changed from "11" to "01" as a result of the edge processing according to the present embodiment. FIG. 24B is an explanatory diagram illustrating how dots are formed when edge processing according to the present embodiment is carried out.

The image obtained according to the present embodiment has dimensions that are substantially equal in both the X' and Y' directions. Further, the rounded outline around the arrows C in FIG. 24B is printed smoothly. Furthermore, around the arrows D in FIG. 24B, large dots are formed next to each other in the X direction. Since a large dot has the shape of an oval with a major axis in the X direction (the scanning direction), the space between the dots becomes small by forming large dots next to each other in the X direction, and therefore, the image quality will not become coarse.

In the description above, a figure in which a predetermined region is filled in (painted out) was printed. The edge processing of the present embodiment, however, is not effective only in such figures.

For example, the edge processing of the present embodiment is equally effective for cases in which the image to be printed is text. In case of printing text, it is necessary to clearly define the outline sections of the text in order to make the printed text easy to read. Further, text printing often involves printing of slanting outline sections and rounded outline sections, and therefore, it is necessary to clearly define those outline sections. In view of this, by carrying out the edge processing of the present embodiment for text images, it is possible to print easy-to-read text on paper.

===Other Embodiments===

The foregoing embodiment centers mainly on a printer. It goes without saying, however, that the foregoing description discloses, for example, printing apparatuses, recording apparatuses, liquid ejecting apparatuses, printing methods, recording methods, ink ejecting methods, printing systems, recording systems, computer systems, programs, computer-readable storage media having programs recorded thereon, display screens, screen displaying methods, and method of manufacturing printed articles.

Further, a printer etc. as an embodiment of the present invention was described above. The foregoing embodiment, however, has been given merely for facilitating understanding of the present invention, and is not to limit the scope of the present invention. It is without saying that the present invention may be altered and/or modified without departing from the gist thereof, and that the present invention includes its equivalents. Particularly, the present invention includes even the embodiments described below.

<About the Directivity>

In the foregoing embodiment, edge processing was carried out with respect to images in which the resolution in the carrying direction is higher than the resolution in the scanning direction. Further, in the foregoing embodiment, three pixels aligned in the scanning direction (i.e., the three pixels, pixel (1), pixel (2), and pixel (3), or the three pixels, pixel (4), pixel (5), and pixel (6)) were taken as the reference pixels. However, the directivity in resolution and the directivity of the reference pixels are not limited to the above.

Figure 25:
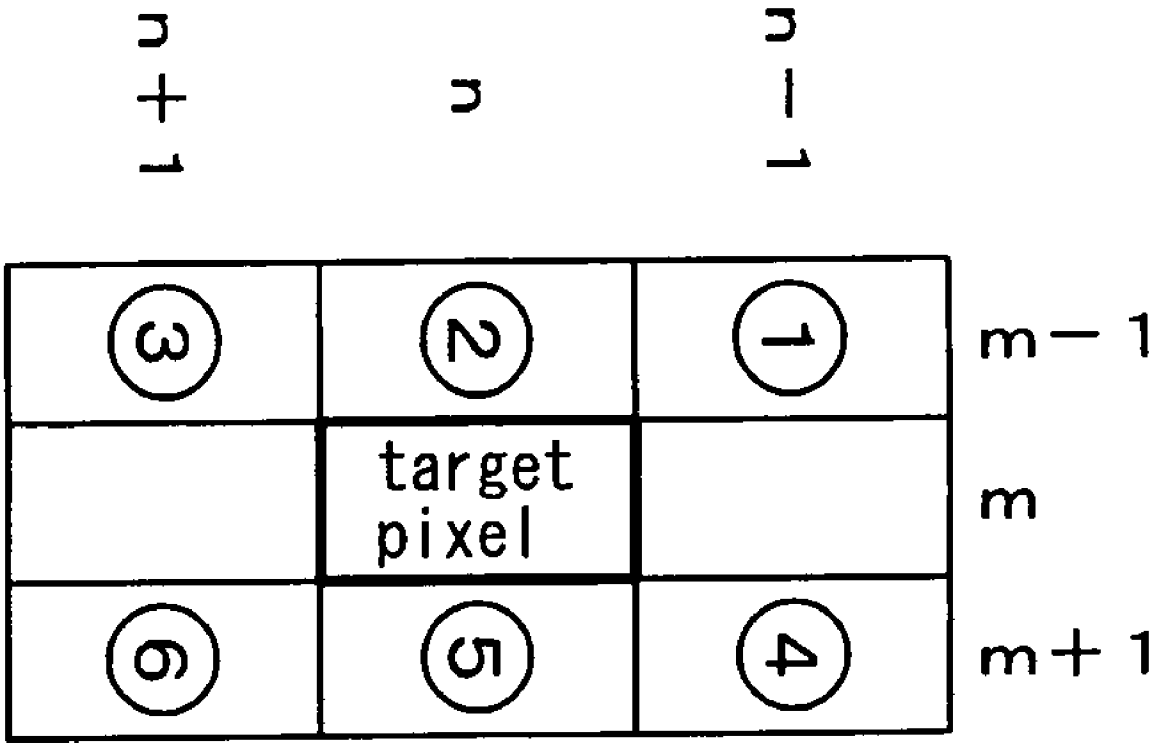
FIG. 25 is an explanatory diagram illustrating edge processing according to another embodiment.

FIG. 25 is an explanatory diagram illustrating edge processing according to another embodiment. This embodiment is targeted for images in which the resolution in the scanning direction is higher than the resolution in the carrying direction.

In the edge processing of this embodiment, pixel data is changed from "11" to "01" if: the pixel data of the target pixel is "11"; and the target pixel is an "edge pixel" as defined in the present embodiment. Here, a target pixel is regarded as an "edge pixel" if the target pixel meets at least one of the following two conditions:

condition 1: the pixel data for all of the pixel (1), the pixel (2), and the pixel (3) are "00"; or condition 2: the pixel data for all of the pixel (4), the pixel (5), and the pixel (6) are "00".

That is, according to this embodiment, the three pixels aligned in the carrying direction (i.e., the three pixels, pixel (1), pixel (2), and pixel (3), or the three pixels, pixel (4), pixel (5), and pixel (6) shown in FIG. 25) are taken as the reference pixels.

Even with this embodiment, it is possible to obtain substantially the same effects as those in the foregoing embodiment. In short, the directivity in resolution and the directivity of the reference pixels are not limited to those of the foregoing embodiment, as long as the directivity in resolution and the directivity of the reference pixels correspond with each other. When the present embodiment and the foregoing embodiment are compared, however, the foregoing embodiment is more preferable taking into account the directivity of the large dots that have an oval shape.

<About the Printer Driver>

In the foregoing embodiment, the printer driver of the computer carried out the edge processing. The edge processing, however, does not necessarily have to be carried out by the printer driver. For example, if a program for achieving necessary functions to carry out the edge processing of the present embodiment is stored in a memory of the printer, then the printer would be capable of carrying out the edge processing described above. In this case, the printer would receive print data having a resolution of 720×720 dpi from the computer and carry out the edge processing based on the pixel data included in the received print data.

Even in this way, it is possible to obtain substantially the same effects as those of the foregoing embodiment.

<About the Resolution Multi-value Conversion Process>

In the foregoing embodiment, the printer driver first generated multi-value data in 360×720 dpi based on binary data in 720×720 dpi, and then carried out the edge processing. The edge processing, however, does not have to be carried out in this -processing order.

For example, the printer driver may calculate edge-processed multi-value data in 360×720 dpi directly from binary data in 720×720 dpi.

<About the Dots>

In the foregoing embodiment, there were two types of dots formed by the head on paper: large dots and small dots. The types of dots formed on paper, however, are not limited to the above. For example, the head may form not only large dots and small dots, but it may form medium dots on the medium.

<About Edge Processing>

According to the edge processing of the foregoing embodiment, the printer driver changed a large dot to a small dot when a large dot is to be formed at a position on the paper corresponding to an edge pixel. The edge processing, however, is not limited to a process of changing a large dot to a small dot.

For example, the printer driver may change a large dot to a medium dot when a large dot is to be formed at a position on the paper corresponding to an edge pixel. Further, the printer driver may change a medium dot to a small dot when a medium dot is to be formed at a position on the paper corresponding to an edge pixel.

<About the Printer>

A printer was described in the foregoing embodiment, but this is not a limitation. Technology such as that of the present embodiment can also be adopted for various recording apparatuses to which inkjet technology is applied, such as color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, or DNA chip manufacturing devices. Also, these methods and manufacturing methods are within the scope of application. When the technology of the present embodiment is applied to such fields, savings in material, process steps, and costs can be achieved compared to conventional cases, because the technology of the present embodiment features direct ejection (direct appliance) of liquid onto a target object.

<About the Ink>

In the foregoing embodiment, ink such as dye ink or pigment ink was ejected from the nozzles, because the foregoing embodiment was about a printer. However, the liquid that is ejected from the nozzles is not limited to such inks. For example, it is also possible to eject, from the nozzles, liquid (including water) such as metallic materials, organic materials (in particular polymeric materials), magnetic materials, conductive materials, wiring materials, film forming materials, electronic ink, machining liquids, genetic solutions, and so forth. Savings in material, process steps, and costs can be achieved if such liquids are directly ejected toward a target object.

<About the Nozzles>

In the foregoing embodiment, ink was ejected using piezoelectric elements. However, the method for ejecting liquid is not limited to this. Other methods, such as a method for generating bubbles in the nozzles using heat, may also be employed.

===Summary===

<About the Printing Apparatus>

The foregoing description was about a printing apparatus (a printer alone or a system including a computer and a printer) that comprises a head that is capable of forming large dots and small dots on paper, and that prints, on the paper, an image whose resolution in the scanning direction (second direction) and the carrying direction (first direction) is 360×720 dpi by forming the large dots or the small dots at positions on the paper that correspond to pixels structuring the image in 360×720 dpi. The printing apparatus forms a small dot at a position on the paper corresponding to a target pixel if a large dot is to be formed at the position on the paper corresponding to the target pixel, and at least either one of condition 1 or condition 2 below is met:

condition 1: no dot is to be formed at a position on the paper corresponding to pixel (2), and no dot is to be formed at positions on the paper corresponding to the two pixels (pixel (1) and pixel (3)) that are adjacent to pixel (2); or condition 2: no dot is to be formed at a position on the paper corresponding to pixel (5), and no dot is to be formed at positions on the paper corresponding to the two pixels (pixel (4) and pixel (6)) that are adjacent to pixel (5).

According to such a printing apparatus, it is possible to improve image quality. Particularly, with this printing apparatus, it is possible to print both slanting outline sections and rounded outline sections smoothly. Since usual images often have an outline in which slanting outline sections and rounded outline sections are continuously connected, the printing apparatus is particularly advantageous in carrying out high-quality printing.

<About the Control Apparatus>

The foregoing description was about a computer that is for correlating either pixel data "11" for a large dot or pixel data "01" for a small dot to each of a plurality of pixels that structure an image whose resolution in the scanning direction (second direction) and the carrying direction (first direction) is 360×720 dpi, and for outputting, to a printer, the pixel data "11" for the large dot and/or the pixel data "01" for the small dot by including the pixel data in print data. The computer changes the pixel data of a target pixel from "11" to "01" if the pixel data of the target pixel is "11", and at least either one of condition 1 or condition 2 below is met:

condition 1: the pixel data of pixel (2) is "00"1 and the pixel data of the two pixels (pixel (1) and pixel (3)) that are adjacent to pixel (2) are "00"; or condition 2: the pixel data of pixel (5) is "00" and the pixel data of the two pixels (pixel (4) and pixel (6)) that are adjacent to pixel (5) are "00".

According to such a control apparatus, it is possible to improve image quality. Particularly, with this control apparatus, it is possible to print both slanting outline sections and rounded outline sections smoothly. Since usual images often have an outline in which slanting outline sections and rounded outline sections are continuously connected, the control apparatus is particularly advantageous in carrying out high-quality printing.

<About the Program (1)>

The foregoing description was about a program (a printer driver, a program for a printer, or a system program including a printer driver and a program for a printer) that causes a printing apparatus (a printer alone or a system including a computer and a printer) comprising a head that is capable of forming large dots and small dots on paper to achieve a function of printing, on the paper, an image whose resolution in the scanning direction (second direction) and the carrying direction (first direction) is 360×720 dpi by forming the large dots or the small dots at positions on the paper that correspond to pixels structuring the image in 360×720 dpi. The program causes the printing apparatus to form a small dot at a position on the paper corresponding to a target pixel if a large dot is to be formed at the position on the paper corresponding to the target pixel, and at least either one of condition 1 or condition 2 below is met:

condition 1: no dot is to be formed at a position on the paper corresponding to pixel (2), and no dot is to be formed at positions on the paper corresponding to the two pixels (pixel (1) and pixel (3)) that are adjacent to pixel (2); or condition 2: no dot is to be formed at a position on the paper corresponding to pixel (5), and no dot is to be formed at positions on the paper corresponding to the two pixels (pixel (4) and pixel (6)) that are adjacent to pixel (5).

According to such a program, it is possible to improve image quality. Particularly, with this program, it is possible to print both slanting outline sections and rounded outline sections smoothly. Since usual images often have an outline in which slanting outline sections and rounded outline sections are continuously connected, the program is particularly advantageous in carrying out high-quality printing.

<About the Program (2)>

The foregoing description was about a printer driver that causes a computer to achieve a function of correlating either pixel data "11" for a large dot or pixel data "01" for a small dot to each of a plurality of pixels that structure an image whose resolution in the scanning direction (second direction) and the carrying direction (first direction) is 360×720 dpi, and a function of outputting, to a printer, the pixel data "11" for the large dot and/or the pixel data "01" for the small dot by including the pixel data in print data. The program causes the computer to achieve a function of changing the pixel data of a target pixel from "11" to "01" if the pixel data of the target pixel is "11", and at least either one of condition 1 or condition 2 below is met:

condition 1:

neither the first dot information nor the second dot information is correlated to one adjacent pixel of either two adjacent pixels that are adjacent, in the first direction, to the certain pixel, and neither the first dot information nor the second dot information is correlated to two pixels that are adjacent, in the second direction, to that one adjacent pixel; or condition 2:

neither the first dot information nor the second dot information is correlated to the other adjacent pixel of the two adjacent pixels, and neither the first dot information nor the second dot information is correlated to two pixels that are adjacent, in the second direction, to the other adjacent pixel.

According to such a printer driver, it is possible to improve image quality. Particularly, with this printer driver, it is possible to print both slanting outline sections and rounded outline sections smoothly. Since usual images often have an outline in which slanting outline sections and rounded outline sections are continuously connected, the printer driver is particularly advantageous in carrying out high-quality printing.

What is claimed is:

1. A printing method for printing, on a medium, an image in which a resolution in a first direction is higher than a resolution in a second direction by forming first dots or second dots that are smaller than said first dots at positions on said medium that correspond to pixels structuring said image, said method comprising the step of forming the second dot at a position on said medium corresponding to a certain pixel if the first dot is to be formed at the position on said medium corresponding to said certain pixel, and at least either one of condition 1 or condition 2 below is met:

condition 1:

neither said first dot nor said second dot is to be formed at a position on said medium corresponding to one adjacent pixel of either two adjacent pixels that are adjacent, in said first direction, to said certain pixel, and neither said first dot nor said second dot is to be formed at positions on said medium corresponding to two pixels that are adjacent, in said second direction, to said one adjacent pixel; or condition 2:

neither said first dot nor said second dot is to be formed at a position on said medium corresponding to the other adjacent pixel of said two adjacent pixels, and neither said first dot nor said second dot is to be formed at positions on said medium corresponding to two pixels that are adjacent, in said second direction, to said other adjacent pixel.

2. A printing method according to claim 1, wherein said first dot is longer in said second direction than in said first direction.

3. A printing method according to claim 2, wherein said first dot has an oval shape.

4. A printing method according to claim 1, wherein:

said first dots and said second dots are formed by a print head;

said print head is movable in a predetermined direction; and said second direction is parallel to said predetermined direction.

5. A printing method according to claim 1, wherein:

said medium is carried in a carrying direction when said medium is being printed; and said second direction is parallel to said carrying direction.

6. A printing method according to claim 1, further comprising the step of converting the resolution of an image having a predetermined resolution in said first direction and a predetermined resolution in said second direction to obtain said image in which the resolution in said first direction is higher than the resolution in said second direction.

7. A printing method according to claim 6, wherein said predetermined resolution in said first direction and said predetermined resolution in said second direction are the same.

8. A printing method according to claim 6, wherein adjacent pixels among pixels that structure said image having the predetermined resolution are taken as a unit and regarded as a new pixel to obtain said image in which the resolution in said first direction is higher than the resolution in said second direction.

9. A printing method according to claim 8, wherein two adjacent pixels among the pixels that structure said image having the predetermined resolution are taken as a unit and regarded as a new pixel.

10. A printing method according to claim 8, wherein adjacent pixels in said second direction among the pixels that structure said image having the predetermined resolution are taken as a unit and regarded as a new pixel.

11. A printing method according to claim 6, wherein an amount of information of pixel data of each of said pixels that structure said image in which the resolution in said first direction is higher than the resolution in said second direction is larger than an amount of information of pixel data of each of said pixels that structure said image having the predetermined resolution.

12. A printing method according to claim 11, wherein said amount of information of said pixel data of each of said pixels that structure said image in which the resolution in said first direction is higher than the resolution in said second direction is at least two bits.

13. A printing method according to claim 11, wherein said amount of information of said pixel data of each of said pixels that structure said image having the predetermined resolution is one bit.

14. A printing method according to claim 1, wherein
the image printed on said medium is an image in which a predetermined region is filled in with said first dots or said second dots.

15. A printing method according to claim 14, wherein
said position on said medium corresponding to said certain pixel is at an outline section of said predetermined region.

16. A printing method according to claim 1, wherein
the image printed on said medium is text.

17. A printing method for printing, on a medium, an image in which a resolution in a first direction is higher than a resolution in a second direction by forming first dots or second dots that are smaller than said first dots at positions on said medium that correspond to pixels structuring said image, said method comprising the step of forming the second dot at a position on said medium corresponding to a certain pixel if the first dot is to be formed at the position on said medium corresponding to said certain pixel, and at least either one of condition 1 or condition 2 below is met:

condition 1:

neither said first dot nor said second dot is to be formed at a position on said medium corresponding to one adjacent pixel of either two adjacent pixels that are adjacent, in said first direction, to said certain pixel, and neither said first dot nor said second dot is to be formed at positions on said medium corresponding to two pixels that are adjacent, in said second direction, to said one adjacent pixel; or condition 2:

neither said first dot nor said second dot is to be formed at a position on said medium corresponding to the other adjacent pixel of said two adjacent pixels, and neither said first dot nor said second dot is to be formed at positions on said medium corresponding to two pixels that are adjacent, in said second direction, to said other adjacent pixel, wherein:

said first dot has an oval shape that is longer in said second direction than in said first direction;

said first dots and said second dots are formed by a print head;

said print head is movable in a predetermined direction;

said second direction is parallel to said predetermined direction;

the resolution of an image having a predetermined resolution in said first direction and a predetermined resolution in said second direction is converted to obtain said image in which the resolution in said first direction is higher than the resolution in said second direction;

said predetermined resolution in said first direction and said predetermined resolution in said second direction are the same;

two pixels adjacent to each other in said second direction among the pixels that structure said image having the predetermined resolution are taken as a unit and regarded as a new pixel to obtain said image in which the resolution in said first direction is higher than the resolution in said second direction;

an amount of information of pixel data of each of said pixels that structure said image in which the resolution in said first direction is higher than the resolution in said second direction is larger than an amount of information of pixel data of each of said pixels that structure said image having the predetermined resolution;

said amount of information of said pixel data of each of said pixels that structure said image in which the resolution in said first direction is higher than the resolution in said second direction is at least two bits;

said amount of information of said pixel data of each of said pixels that structure said image having the predetermined resolution is one bit;

the image printed on said medium is an image in which a predetermined region is filled in with said first dots or said second dots;

said position on said medium corresponding to said certain pixel is at an outline section of said predetermined region; and the image printed on said medium is text.

18. A control method for correlating either first dot information about a first dot or second dot information about a second dot that is smaller than said first dot to each of a plurality of pixels that structure an image in which a resolution in a first direction is higher than a resolution in a second direction, and for outputting said first dot information and said second dot information, said method comprising the step of correlating said second dot information to a certain pixel if said first dot information is correlated to said certain pixel, and at least either one of condition 1 or condition 2 below is met:

condition 1:

neither said first dot information nor said second dot information is correlated to one adjacent pixel of either two adjacent pixels that are adjacent, in said first direction, to said certain pixel, and neither said first dot information nor said second dot information is correlated to two pixels that are adjacent, in said second direction, to said one adjacent pixel; or condition 2:

neither said first dot information nor said second dot information is correlated to the other adjacent pixel of said two adjacent pixels, and neither said first dot information nor said second dot information is correlated to two pixels that are adjacent, in said second direction, to said other adjacent pixel.

19. A printing apparatus comprising:

a head that is capable of forming, on a medium, first dots and second dots that are smaller than said first dots;

wherein said printing apparatus prints, on said medium, an image in which a resolution in a first direction is higher than a resolution in a second direction by forming said first dots or said second dots at positions on said medium that correspond to pixels structuring said image; and wherein said printing apparatus forms the second dot at a position on said medium corresponding to a certain pixel if the first dot is to be formed at the position on said medium corresponding to said certain pixel, and at least either one of condition 1 or condition 2 below is met:

condition 1:

neither said first dot nor said second dot is to be formed at a position on said medium corresponding to one adjacent pixel of either two adjacent pixels that are adjacent, in said first direction, to said certain pixel, and neither said first dot nor said second dot is to be formed at positions on said medium corresponding to two pixels that are adjacent, in said second direction, to said one adjacent pixel; or condition 2:

neither said first dot nor said second dot is to be formed at a position on said medium corresponding to the other adjacent pixel of said two adjacent pixels, and neither said first dot nor said second dot is to be formed at positions on said medium corresponding to two pixels that are adjacent, in said second direction, to said other adjacent pixel.

20. A control apparatus comprising a controller for:

correlating either first dot information about a first dot or second dot information about a second dot that is smaller than said first dot to each of a plurality of pixels that structure an image in which a resolution in a first direction is higher than a resolution in a second direction;

outputting said first dot information and said second dot information; and correlating said second dot information to a certain pixel if said first dot information is correlated to said certain pixel, and at least either one of condition 1 or condition 2 below is met:

condition 1:

neither said first dot information nor said second dot information is correlated to one adjacent pixel of either two adjacent pixels that are adjacent, in said first direction, to said certain pixel, and neither said first dot information nor said second dot information is correlated to two pixels that are adjacent, in said second direction, to said one adjacent pixel; or condition 2:

neither said first dot information nor said second dot information is correlated to the other adjacent pixel of said two adjacent pixels, and neither said first dot information nor said second dot information is correlated to two pixels that are adjacent, in said second direction, to said other adjacent pixel.

21. A computer-readable storage medium having recorded thereon a computer program for causing a printing apparatus comprising a head that is capable of forming, on a medium, first dots and second dots that are smaller than said first dots to achieve functions of:

printing, on said medium, an image in which a resolution in a first direction is higher than a resolution in a second direction by forming said first dots or said second dots at positions on said medium that correspond to pixels structuring said image; and forming the second dot at a position on said medium corresponding to a certain pixel if the first dot is to be formed at the position on said medium corresponding to said certain pixel, and at least either one of condition 1 or condition 2 below is met:

condition 1:

neither said first dot nor said second dot is to be formed at a position on said medium corresponding to one adjacent pixel of either two adjacent pixels that are adjacent, in said first direction, to said certain pixel, and neither said first dot nor said second dot is to be formed at positions on said medium corresponding to two pixels that are adjacent, in said second direction, to said one adjacent pixel; or condition 2:

neither said first dot nor said second dot is to be formed at a position on said medium corresponding to the other adjacent pixel of said two adjacent pixels, and neither said first dot nor said second dot is to be formed at positions on said medium corresponding to two pixels that are adjacent, in said second direction, to said other adjacent pixel.

22. A computer-readable storage medium having recorded thereon a computer program for causing a control apparatus comprising a controller to achieve functions of:

correlating either first dot information about a first dot or second dot information about a second dot that is smaller than said first dot to each of a plurality of pixels that structure an image in which a resolution in a first direction is higher than a resolution in a second direction;

outputting said first dot information and said second dot information; and correlating said second dot information to a certain pixel if said first dot information is correlated to said certain pixel, and at least either one of condition 1 or condition 2 below is met:

condition 1:

neither said first dot information nor said second dot information is correlated to one adjacent pixel of either two adjacent pixels that are adjacent, in said first direction, to said certain pixel, and neither said first dot information nor said second dot information is correlated to two pixels that are adjacent, in said second direction, to said one adjacent pixel; or condition 2:

neither said first dot information nor said second dot information is correlated to the other adjacent pixel of said two adjacent pixels, and neither said first dot information nor said second dot information is correlated to two pixels that are adjacent, in said second direction, to said other adjacent pixel.

* * * * *